US009750116B2

(12) United States Patent
Witzgall

(10) Patent No.: US 9,750,116 B2
(45) Date of Patent: Aug. 29, 2017

(54) AUTOMATED AND PRE-CONFIGURED SET UP OF LIGHT SCENES

(71) Applicant: Lumifi, Inc., New York, NY (US)

(72) Inventor: Beatrice Witzgall, New York, NY (US)

(73) Assignee: LUMIFI, INC., New York, NY (US)

( * ) Notice: Subject to any disclaimer, the term of this patent is extended or adjusted under 35 U.S.C. 154(b) by 0 days.

(21) Appl. No.: 14/916,484

(22) PCT Filed: Jul. 29, 2015

(86) PCT No.: PCT/US2015/042640
§ 371 (c)(1),
(2) Date: Mar. 3, 2016

(87) PCT Pub. No.: WO2016/019005
PCT Pub. Date: Feb. 4, 2016

(65) Prior Publication Data

US 2016/0286630 A1 Sep. 29, 2016

Related U.S. Application Data

(60) Provisional application No. 62/030,251, filed on Jul. 29, 2014.

(51) Int. Cl.
*H05B 37/02* (2006.01)
*F21S 6/00* (2006.01)
(Continued)

(52) U.S. Cl.
CPC ..... *H05B 37/0272* (2013.01); *F21S 6/002* (2013.01); *F21S 6/008* (2013.01);
(Continued)

(58) Field of Classification Search
CPC ..... H05B 37/0272; H05B 37/0227; H05B 37/0281; F21S 6/002; F21S 6/008; F21S 8/026; F21S 8/032; F21S 8/033
(Continued)

(56) References Cited

U.S. PATENT DOCUMENTS 8,368,310 B1 * 2/2013 Roosli ..... H05B 37/0245 315/152
8,463,408 B2 6/2013 Ribas
(Continued)

FOREIGN PATENT DOCUMENTS

JP 2002-43074 2/2002
WO 2006/008464 A2 1/2006
(Continued)

OTHER PUBLICATIONS

Jan. 2015: ZDNet: CES 2015: the home automation challenge. http://www.zdnet.com/article/ces-2015-the-home-automation-challenge/.
(Continued)

*Primary Examiner* — Dylan White
(74) *Attorney, Agent, or Firm* — Dorf & Nelson LLP; Scott D. Locke, Esq.

(57) ABSTRACT

The present invention provides methods and systems for setting up light scenes. These methods and system automate the control of variable parameters after defining a set of fixtures and static properties of the fixtures in a given environment and a selected mood.

16 Claims, 15 Drawing Sheets

(51) Int. Cl.
*F21S 8/00* (2006.01)
*F21S 8/02* (2006.01)
*F21W 121/00* (2006.01)

(52) U.S. Cl.
CPC ..... *F21S 8/026* (2013.01); *F21S 8/032* (2013.01); *F21S 8/033* (2013.01); *H05B 37/029* (2013.01); *H05B 37/0227* (2013.01); *H05B 37/0245* (2013.01); *H05B 37/0281* (2013.01); *F21W 2121/00* (2013.01)

(58) Field of Classification Search
USPC ..... 315/297
See application file for complete search history.

(56) References Cited

U.S. PATENT DOCUMENTS

| | | | | |
|---|---|---|---|---|
| 2002/0180973 | A1 | 12/2002 | MacKinnon | |
| 2009/0085494 | A1 | 4/2009 | Summerland | |
| 2011/0190913 | A1* | 8/2011 | Van De Sluis | A63J 17/00 700/94 |
| 2012/0306381 | A1 | 12/2012 | Adler | |
| 2013/0038219 | A1 | 2/2013 | Dau | |
| 2015/0015165 | A1* | 1/2015 | Engelen | H04B 10/1143 315/294 |
| 2015/0091473 | A1* | 4/2015 | Clavenna, II | H05B 37/0227 315/297 |
| 2016/0037613 | A1* | 2/2016 | Laherty | H05B 37/0272 315/294 |

FOREIGN PATENT DOCUMENTS

| | | | | |
|---|---|---|---|---|
| WO | 2009/060377 | A2 | 5/2009 | |
| WO | WO2016019005 | A1 * | 2/2016 | H05B 33/08 |

OTHER PUBLICATIONS

Jan. 2015: LaunchIT ICES Showstoppers: LumiFi's innovative connected lighting technology. http://us5.campaign-archive1.com/?u=ac2e8bb12be746233dbd6c8cf&id=8215b45e1b&e=c4218aeed1.
Nov. 2014: The Next Web: 10 more exciting early-stage start-ups to look out for. http://thenextweb.com/voice/2014/11/06/10-exciting-early-stage-startups-look/.
Oct. 2014: The Next Web: What must happen to spark mass adoption of connected lighting? http://thenextweb.com/dd/2014/10/09/must-happen-spark-mass-adoption-connected-lighting/.
Oct. 2014: Xconomy: LumiFi App Brings Curated Mood Lighting to the Connected Home Scene. http://www.xconomy.com/new-york/2014/10/06/lumifi-app-brings-curated-mood-lighting-to-the-connected-home-scene/.
Aug. 2014: MacLife: New App Recap: LumiFi . http://www.maclife.com/article/ipod_and_iphone/new_app_recap_august_11_2014#slide-6.
Jul. 2014: FutureZone: Die Wahl der Innovation des Jahres powered by Philips: #8 LumiFi. http://futurezone.at/myfuzo/die-wahl-der-innovation-des-jahres-powered-by-philips/89.558.
Witzgall, Beatrice, "Lightmospheres" Take Control of Your Environment, Linked-In (Jul. 21, 2015).
International Search Report and Written Opinion, PCT/US15/42640, WIPO Jul. 29, 2015.
Jan. 2016: Hospitality Interiors, January-February Issue, pp. 8-15: Hospitality Lighting Trends 2016. http://edition.pagesuite-professional.co.uk/launch.aspx?eid=9c37d67e-89dc-4535-b021-455b5859d36e&error=1&debug=a685296f-0ab5-4b3c-82bc-de2c71b62fd4.
Jan. 2016: Yachting Magazine, January Issue, p. 48: Design Matters. https://www.dropbox.com/home/UpSpring%20PR%20Internal/client%20press%20clips/LumiFi/2016?preview=January+2016+Issue_Yachting+Magazine_+Lumifi.pdf.
Nov. 2015: Today's Leading Women: How To Bring Your Lights To Life with Beatrice Witzgall. http://todaysleadingwomen.com/beatrice-witzgall/.
Sep. 2015: Architectural Lighting: High-Tech Lights to Help Baby Sleep. http://www.archlighting.com/newsletter/high-tech-lights-help-baby-sleep-or-students-stay-alert_c.
Sep. 2015: The New York Times: High-Tech Lights to Help Baby Sleep, or Students Stay Alert. http://www.nytimes.com/2015/09/12/business/energy-environment/high-tech-lights-to-help-baby-sleep-or-students-stay-alert.html?_r=2.
Aug. 2015: Mondo Arc: Lighting talk, Beatrice Witzgall. http://issuu.com/mondiale/docs/ma86_digital_issuu/46.
Aug. 2015: Forbes: LumiFi: Controlling Lighting from Your Smartphone. http://www.forbes.com/sites/andrewweinreich/2015/08/07/lumifi-roadmap-video/.
Aug. 2015: DZone: The DZone Guide to the Internet of Things: "Executive Insights on The Internet of Things." https://dzone.com/storage/assets/162677-dzone-2015-iot-2.pdf.
Jun. 2015: The Native Society: Beatrice Witzgall: Founder & CEO of LumiFi. http://thenativesociety.com/nativeadmission/2015/6/26/beatrice-witzgall-founder-ceo-of-lumifi.html.
May 2015: Creator Magazine: LumiFi: Let Your Mood Illuminate the Room. https://creator.wework.com/techcrunchdisrupt/let-your-mood-illuminate-the-room/.
May Issue 2015: A1 Lighting Magazine: Eyes On . . . LumiFi. http://flickread.com/edition/html/index.php?pdf=5543625511def#42.
May 2015: The Legacy Project: Beatrice Witzgall | CEO and Founder of Lumifi. http://thelegacyproject.co.za/beatrice-witzgall-ceo-and-founder-of-lumifi/.
Apr. 2015: Huffington Post Business: Women in Business Q&A: Beatrice Witzgall, CEO and Founder, LumiFi. http://www.huffingtonpost.com/laura-dunn/women-in-business-qa-beat_b_7045816.html.
Apr. 2015: About Design Magazine: Award: Lighting Control Software: LumiFi by Beatrice Witzgall. http://aboutdesignmagazine.com/article.php?ID=867.
Mar. 2015: Claim Magazine—Award: Lighting Control Software: LumiFi by Beatrice Witzgall. http://www.claimmagazine.com/article.php?ID=998.
Mar. 2015: The Product Designer: Lighting Control Software by Beatrice Witzgall. http://www.theproductdesigner.com/article.php?ID=994.
Jan. 2015: Xconomy: Need for New Approaches to Encourage Women to Join, and Stay in, Tech. http://www.xconomy.com/newyork/2015/01/06/needfornewap-proachestoencouragewomentojoinandstayintech/2/.
Feb. 2016: LEDs Magazine: Will IoT-enabled lighting controls be the death of traditional light switches?, Print Version only in Feb. 2016 Issue, p. 80. http://www.ledsmagazine.com/articles/print/volume-13/issue-2/columns-departments/last-word/will-iot-enabled-lighting-controls-be-the-death-of-traditional-light-switches.html.
Feb. 2016: Hotel Business Design: Enhance experience through innovation, Print Version only in the Feb. 7th Issue, p. 22-23. http://static.ow.ly/docs/Hotel%20Business%20-%20February%207,%202016-sm_4kJt.pdf.
Jan. 2016: LEDinside: Interoperability Is Still the Biggest Hurdle for Smart Lighting. http://www.ledinside.com/interview/2016/1/lumifi_ceo_interoperability_is_still_the_biggest_hurdle_for_smart_lighting.
Jan. 2016: EDN Network: The Death of the Light Switch. http://www.edn.com/electronics-blogs/led-zone/4441234/The-death-of-the-light-switch.
Nov. 2015: Architectural Products Magazine, November Issue, p. 18. http://arch-products.com/fastpath/issuu/?i=31570626.
Nov. 2015: Internet of Things Today: What is Value of Smart Lighting in Standalone Systems in Relationship to Ecosystems or Platforms? http://www.iot-today.com/main/articles/what-is-value-of-smart-lighting-in-standalone-systems-in-relationship-to-ecosystems-or-platforms/#more-11874.

(56) References Cited

OTHER PUBLICATIONS

Nov. 2015: Internet of Things Journal: The Current Problem With Value Creation in the IoT Smart Lighting Industry. http://www.iotjournal.com/articles/view?13694.
Nov. 2015: West Coast Lighting Insider: The Error in the Current Smart Lighting Business Model. http://www.lightshowwest.com/error_in_smart_lighting_business_model.
Nov. 2015: Made in China: LumiFi Files Patent for Smart Lighting Control Market. http://resources.made-in-china.com/article/industry-view/VmgxOBKrOnIR/LumiFi-Files-Patent-for-Smart-Lighting-Control-Software/.
Nov. 2015: DZone: Additional Considerations Regarding the Internet of Things. https://dzone.com/articles/additional-considerations-regarding-the-internet-o.
Nov. 2015: enLIGHTenment Magazine: Smart Lighting in the Age of the Internet of Things. http://www.enlightenmentmag.com/Magazine/November-2015/Lighting-Magazine-November-2015.html#p=60.
Oct. 2015: Lightecture, Issue 19, p. 10. http://www.youblisher.com/p/1232052-Lightecture-19/.
Oct. 2015: Zondits: Energy Efficient LED Bulbs That Can Help You Sleep Better. http://www.zondits.com/article/10622/bright-idea-energy-ethcient-led-bulbs.
Sep. 2015: App Masters Podcast: The Future of Smart Lighting with Beatrice Witzgall. http://www.appmasters.co/lumifi-beatrice-witzgall/.
Aug. 2015: BizLED Magazine: New software for hotels that allows total lighting control. http://bizled.co.in/new-software-for-hotels-that-allows-total-lighting-control/?utm_source=NLAug31&utm_medium=NLAug31&utm_campaign=NLAug31.
Aug. 2015: LEDinside: LumiFi Files Patent for Smart Lighting Control Software. http://www.ledinside.com/news/2015/8/lumifi_files_patent_for_smart_lighting_control_software.
Jul. 2015: SNAP Magazine: LumiFi. http://www.nxtbook.com/nxtbooks/mh/snap_20150708/index.php?startid=1#/32.
Jul. 2015: Xconomy: Astro Twists in Its Smart Light Bulbs in Connected Apartments. http://www.xconomy.com/new-york/2015/07/10/astro-twists-in-its-smart-light-bulbs-in-connected-apartments/.
Jul. 2015: Interiors & Sources: LumiFi: Digital Toolbox: LumiFi's Light Control App. http://digital.interiorsandsources.com/interiorsandsources/july_2015#pg1.
Jul. 2015: Meet Advisors: This is the "Land of the Free." Take Advantage of It. http://www.meetadvisors.com/post/this-is-the-land-of-the-free-take-advantage-of-it.
June Issue 2015: A1 Lighting: LumiFi, Staying in Control. http://flickread.com/edition/html/index.php?pdf=5572b23a533ac#16.
Jun. 2015: Hospitality Design: Special Judges Award: Technology. http://www.hospitalitydesign.com/news/awards-events/11th-Annual-HD-Awards-Winners-and-Finalists-Announced-12889.shtml.
Jun. 2015: Hospitality Design Award: LumiFi—The Intuitive Lighting Experience App. http://www.hospitalitydesign.com/news/awards-events/11th-Annual-HD-Awards-Winners-and-Finalists-Announced-12889.shtml.
May 2015: The Lighting Guy Podcast: Episode 11, Arch SSL—LumiFi (around minute 14:25). http://avnation.tv/shows/lighting-guy/tlg_011/.
May 2015: PC Magazine: The Most Interesting Products of TechCrunch Disrupt. http://forwardthinking.pcmag.com/none/334502-the-most-interesting-products-of-techcrunch-disrupt.
May 2015: Xconomy—LumiFi: Sombar's Robot Bartender Trying to be the "Keurig of Cocktails." http://www.xconomy.com/new-york/2015/05/08/somabars-robot-bartender-trying-to-be-the-keurig-of-cocktails/.
Apr. 2015: Architectural Products: Curated Controls. http://www.arch-products.com/productwire/archives.asp?PW_ID=192.
Mar./Apr. 2015: Hospitality Interiors: LumiFi—The Intuitive Lighting Experience App. http://edition.pagesuite-professional.co.uk/Launch.aspx?EID=27acdd6a-0cde-45ea-8ea6-65407049407f.
Apr. 2015: Hospitality Design: HD Awards Finalists Announced. http://www.hospitalitydesign.com/news/awards-events/11th-Annual-HD-Awards-Winners-and-Finalists-Announced-12889.shtml.
Mar. 2015: BIZLED: New Software for hotels that allows total control. http://bizled.co.in/new-software-for-hotels-that-allows-total-lighting-control/.
Mar. 2015: Automated Buildings Column: AHR Chicago: Not So enLIGHTening. http://automatedbuildings.com/news/mar15/columns/150228093101mcmillan.html.
International Searching Authority, International Preliminary Report of Patentability, PCTUS15/42640, Jan. 31, 2017.

* cited by examiner

460

| LIGHT FIXTURE TYPE (DIMMABLE EXAMPLE) | | ON | SCENE 1: ENERGIZE | SCENE 2: RELAX | SCENE 3: FOCUS | SCENE 4: REST | OFF |
|---|---|---|---|---|---|---|---|
| 1 | FOYER DOWNLIGHT | 100% | 100% | 20% | 30% | 0% | 0% |
| 2 | FLOOR LAMP | 100% | 100% | 60% | 60% | 20% | 0% |
| 3 | DESK LAMP | 100% | 70% | 40% | 100% | 0% | 0% |
| 4 | BEDSIDE LAMP 1 | 100% | 60% | 60% | 80% | 10% | 0% |
| 5 | BEDSIDE LAMP 2 | 100% | 60% | 60% | 80% | 10% | 0% |
| 6 | BACKLIT BEDREST | 100% | 90% | 50% | 40% | 20% | 0% |
| 7 | BATHROOM DOWNLIGHT | 100% | 80% | 40% | 10% | 0% | 0% |
| 8 | BATHROOM MIRROR | 100% | 100% | 80% | 60% | 30% | 0% |

FIGURE 9A
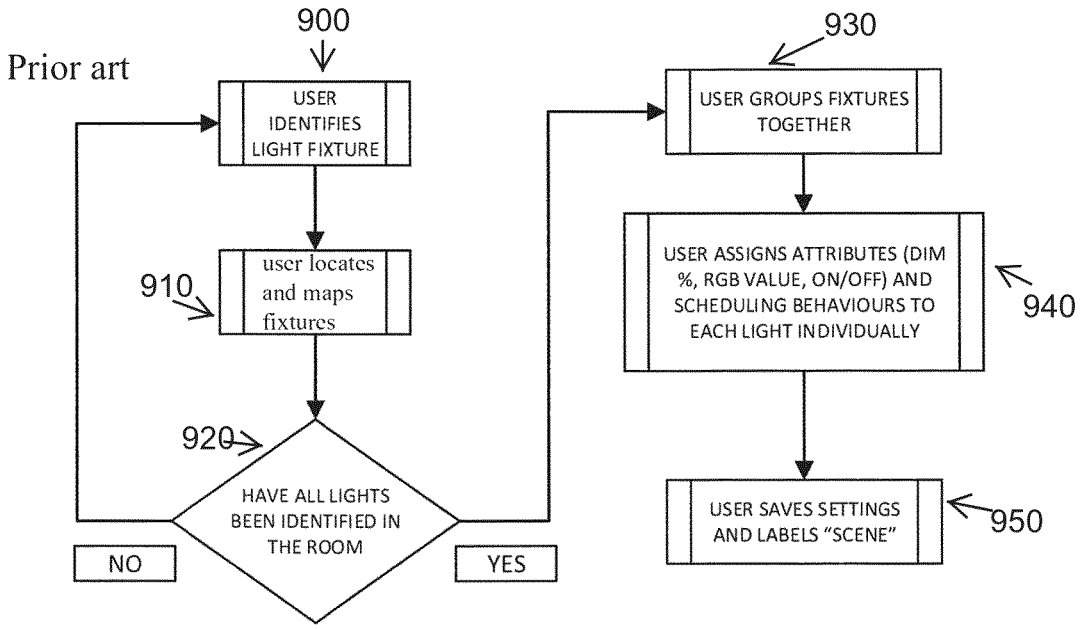
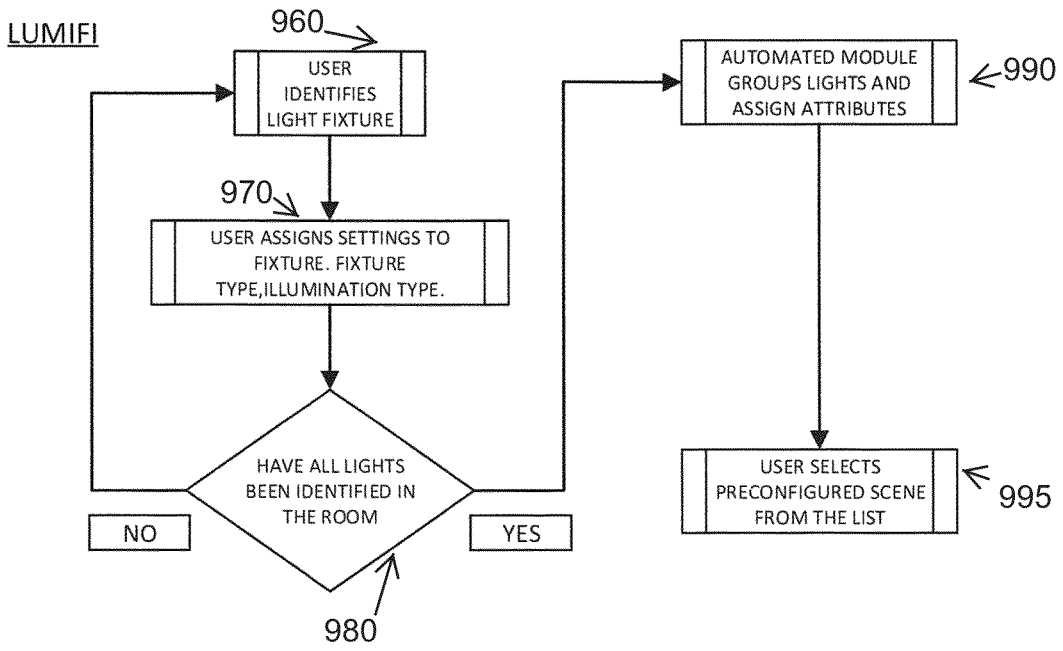
FIGURE 9B

AUTOMATED AND PRE-CONFIGURED SET UP OF LIGHT SCENES

CROSS-REFERENCE TO RELATED APPLICATION

The present application is a national stage application of PCT/US2015/042640, filed Jul. 29, 2015, which claims the benefit of the filing date of U.S. provisional patent application Ser. No. 62/030,251, filed Jul. 29, 2014, the entire disclosures of which are incorporated by reference.

FIELD OF THE INVENTION

The present invention relates to the field of lighting.

BACKGROUND OF THE INVENTION

Lighting systems, lighting apparatuses, and methods of controlling the same are known. However, known technologies suffer from various disadvantages, particularly when trying to establish a mood in an environment by creating a light scene and when trying to be responsive and adaptive to real-time input or automatic configurations. For example, light scenes have traditionally been created by setting the dimming or intensity level of each light fixture manually and separately. Unfortunately, untrained users typically have difficulty finding the optimum settings, and they must work by trial and error, frequently being dissatisfied with the ultimate product. Another option is to retain specially trained experts, but even for them, the process can be labor intensive. Thus, control of individual light sources can be tedious and ineffective.

To date, there is an unmet need for an efficient process in which lighting scenes can be pre-configured and optionally, be automated and adaptively managed. There is also an unmet need for systems that are capable of supporting multiple lighting combinations to accommodate various moods and functions of multiple people and that are capable of providing a method of easily adjusting and alternating between those combinations or changing from one to the other automatically based on users' behaviors and needs.

SUMMARY OF THE INVENTION

The present invention provides methods and systems for the efficient set-up of lighting scenes and the use and customization of pre-programmed scenes, as well automated adaptation to users' lighting needs for certain activities, functions and moods. Through the various embodiments of the present invention, one can efficiently and effectively use computer technology to configure a plurality of lighting scenes in one or more environments for one or more users and to allow these and other users to easily use and adapt these scenes without possessing expert knowledge.

According to a first embodiment, the present invention provides a method for creating a mood lighting scene for an environment, said method comprising: (a) receiving a profile for each of a plurality of lighting fixtures within a set of lighting fixtures for an environment, wherein the profile comprises a set of static properties and a set of variable properties, wherein the set of static properties comprises a fixture type and the set of variable properties comprises a controllable feature that when controlled corresponds to an illumination value; (b) activating a computer protocol, wherein the computer protocol applies an algorithm to the profile of each of the lighting fixtures in the set of lighting fixtures, wherein the algorithm assigns an absolute or relative value for each of the variable properties to generate a set of illuminations values that comprises an illumination value for each fixture for a mood lighting scene; (c) generating a mood scene profile for the mood lighting scene, wherein the mood scene profile comprises a set of illumination instructions for the set of lighting fixtures for the mood lighting scene, wherein the set of illumination instructions corresponds to the set of illuminations values; (d) receiving a request to implement a selected mood lighting scene; and (e) transmitting a digital data message, wherein the digital data message comprises the illumination instructions for the selected mood lighting scene, wherein when implemented, the set of illumination instructions causes the set of lighting fixture to generate the selected mood lighting scene. An "algorithm" may be any set of instructions that upon receipt of an input, follows a set of steps, and as a consequence of following those steps generates an output. An algorithm may or may not be in computer code and may or may not include one or more mathematical formulas.

According to a second embodiment, the present invention provides a method for setting a mood lighting scene for an environment, said method comprising: (a) receiving a profile $(A,B_x)_n$ for each of 1 to n fixtures in the environment, wherein A=a fixture type selected from the group consisting of down light, table light, wall sconce, floor lamp, pendant, up light, step light and strip light (and optionally an area/volume light or a default value if no fixture type is assigned), wherein $B_x$=maximum illumination value and n=1 to 100; (b) for each scene within a set of m scenes, generating a set of scene implementation parameters $(B_{x'})_{n,m}$ for each fixture for each scene, wherein each combined set of scene implementation parameters for the n fixtures for each scene, when implemented generates a different mood lighting scene, wherein m=at least 2, and $B_{x'}$=implementation illumination value; (c) receiving a request to implement a mood lighting scene in the environment; and (d) transmitting an instruction to each fixture, wherein the instruction sent to each fixture comprises the scene implementation parameter for that fixture for the mood lighting scene. $B_x$ is the variable property, and when there is a range, the fixture may dimmable. Alternatively, $B_x$ can be defined as follows: $B_x$=on/off if the fixture is only switched (or switchable) or $B_x$=a color changing value if the fixture contains chips with multiple color values (e.g., an RGB value or a color temperature in Kelvin) or light wave shifting. In these case $B_{x'}$ may be defined to correspond to the implementation value for that variable property.

According to a third embodiment, the present invention provides a method for creating a database of at least one mood lighting scene for an environment, said method comprising: (a) receiving a profile $(A,B_x)_n$ for each of 1 to n fixtures in the environment, wherein A=a fixture type selected from the group consisting of down light, table light, wall sconce, floor lamp, pendant, up light, step light and strip light, $B_x$=maximum illumination value, and n=1 to 100; (b) for each scene within a set of m scenes, generating a set of scene implementation parameters $(B_{x'})_{n,m}$ for each fixture for each scene, wherein each combined set of scene implementation parameters for the n fixtures for each scene, when implemented generates a different mood lighting scene, wherein m=at least 2, and $B_{x'}$=implementation illumination value; (c) optionally receiving a request to implement a mood lighting scene in the environment and implementing the mood lighting scene; and (d) for each scene storing in a database an instruction for each fixture, wherein the instruction comprises the scene implementation parameter for that fixture for that scene.

According to a fourth embodiment, the present invention is directed to a system for setting a mood lighting scene for an environment, wherein the system comprises: (1) an executable computer program product that when executed carries out the steps of one or more of the methods described herein; (2) a central processing unit, wherein the central processing unit is capable of (i) carrying out the steps of one or more of the methods described herein, (ii) receiving input of a profile for each lighting device within a set of lighting devices, and (iii) transmitting instructions to one or more illumination devices; and (3) a set of illumination devices, wherein each illumination device is configured to receive said instructions and when said instructions are executed by the set of illumination devices to create the mood lighting scene in the environment.

Through the various embodiments of the present invention, a user is able to leverage the internet of things and to set up, to use and to customize mood lighting scenes for one or more users for one or more environments. Thus, various embodiments of the present invention allow the automatic grouping of individual light fixtures into various mood scenarios and allow easy access without requiring a user to touch or otherwise physically access a light fixture switch. These technologies allow for more efficient energy usage, reduction of setup and configuration time, and a more enjoyable and meaningful experience in environments in which the lighting scenes are implemented.

BRIEF DESCRIPTION OF THE FIGURES

FIGS. 9A and 9B are representations of a known approach for setting up a light scene and an embodiment of the present invention that is automated.

DETAILED DESCRIPTION OF THE INVENTION

Figure 1:
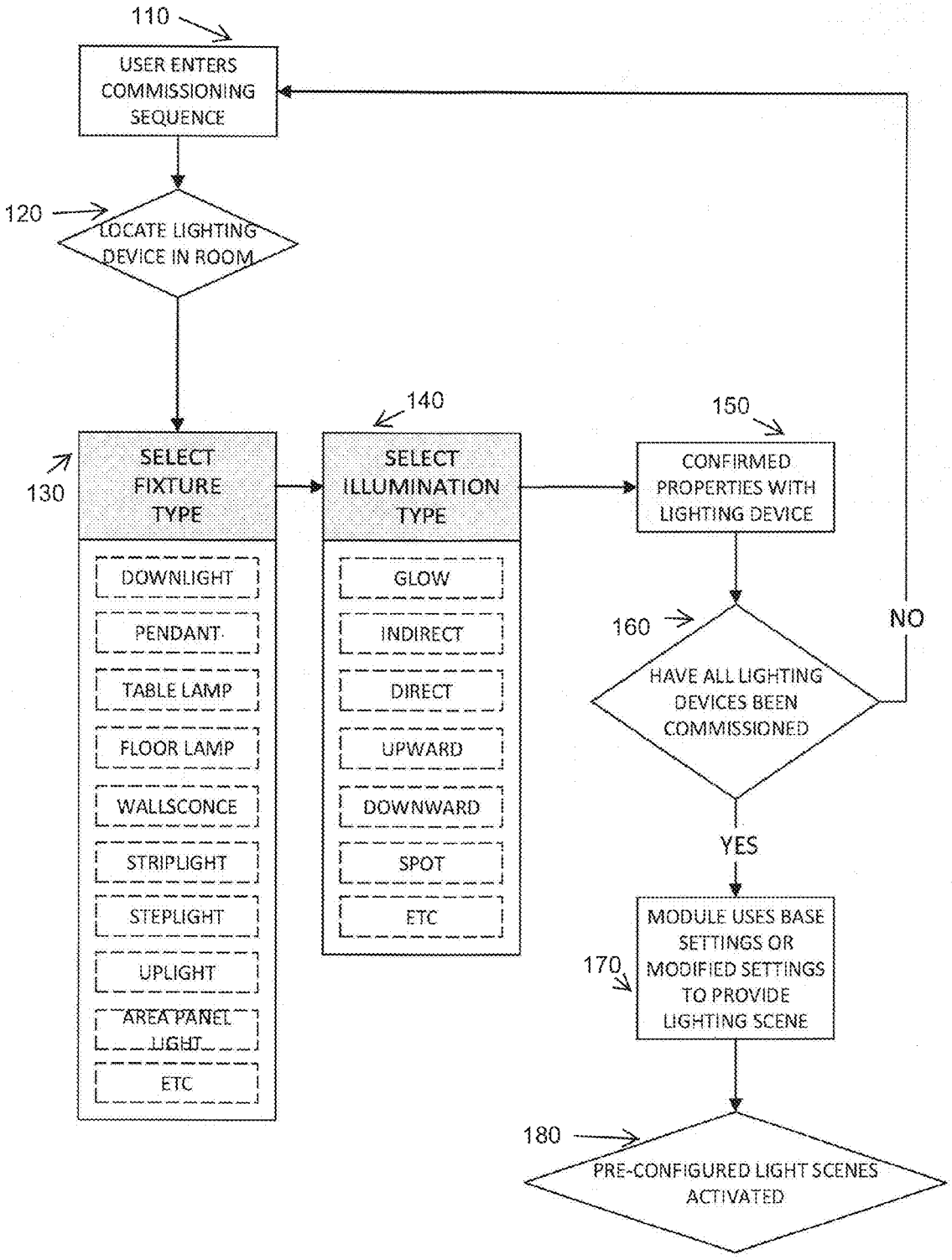
FIG. 1 is a representation of a process of fixture configuration.

Reference will now be made in detail to various embodiments of the present invention, examples of which are illustrated in the accompanying figures. In the following detailed description, numerous specific details are set forth in order to provide a thorough understanding of the present invention. However, unless otherwise indicated or implicit from context, the details are intended to be examples and should not be deemed to limit the scope of the invention in any way. Furthermore, headings are provided for the convenience of the reader and are not intended to be and should not be construed as limiting any of the embodiments described herein.

According to a first embodiment, the present invention provides a method for setting a mood lighting scene for an environment. This method may be automated through computing technologies and may be used to generate new scenes for a known environment, and to create scenes for new environments.

Moods

A mood lighting scene is a configuration of a set of one or more lighting fixtures that is designed to set a mood or light scene. A "mood" is an impression that is created for persons in an environment such as a room, and it may cause particular visual, functional, emotional, physiological, or biological experiences or a combination thereof. For convenience, when a method is designed to allow the creation of a plurality of different mood lighting scenes, each mood lighting scene is a set of concrete instructions for a particular environment, but the same mood may be created in the same environment by changing the number and/or type of fixtures and in different environments by considering the fixtures that are available for that environment. Moods may be defined by discrete illumination parameters for specific environments with known fixture types and also considered relative to other moods.

A mood may be created by considering at least one characteristics of each fixture, e.g., fixture type that is available for use in an environment and the variables that are controllable for that fixture. Procedurally, this may, for example, involve: (i) accessing a database that contains a set of instructions for those same combination of fixtures; or (ii) generating a set of instructions based on a set of rules and receipt of an input that comprises the set of fixtures available and controllable variables for those fixtures; or (iii) accessing a database that contains a set of instructions for a selected environment and/or base settings by that static properties, e.g., fixture type to be used in new environments and modifying those instructions based on differences between the set of instructions stored in the database and one or more of differences in the fixture types and the number of fixtures in the new environment. Optionally, the mood may be created by additionally considering spatial information about the location, the demographic information of a user, natural light sources, time of day and/or day or the week and/or month or season.

The controllable variable or variables may be used to manipulate the output of the lighting fixtures with respect to physical properties of the fixtures such as intensities (which may be along a continuum or in a small number of discrete intensities, e.g., 2-6), on/off status (which is binary), color changing values (which typically range from 0-255, e.g., for an RGB module that is made out of Red/Green/Blue chips the setting for white is 255/255/255, while for black is it 0/0/0), and dynamic white light properties (which may be measured in terms of Kelvin temperature of 2200 degrees to 7000 degrees, with a warm white fluorescent lamp being approximately 3000K, a cool white fluorescent lamp being approximately 4000K, a clear metal halide lamp being approximately 4500K, a pure white light being approximately 5000K, and a daylight fluorescent lamp being approximately 6500K), or light wave shifting bulbs to support circadian rhythms and biological effects as they are developed. Some light fixtures will have more than one of these parameters. For fixtures that have a dimming capability, there may or may not be a separate on/off status variable. Typically, a color changing feature will also be able to adjust brightness. Additionally, as persons of ordinary skill in the art will recognize, these features are neither mutually exclusive, nor limiting to the scope of features to which the present invention applies. As these persons will also recognize, control of RGB values and dynamic white light properties are examples of control of color values, and even in a system that allows only for control of RGB values, one may be able to generate a white light, though it may be less pure than a white light generated though a dynamic white light capability. For all of these physical properties, the variables may be controlled without a user physically moving the fixture or touching a switch or device physically connected to the fixture.

The systems and methods of the present invention may be used to create one or more moods for one or more environments. For example, they may be used to create 1, 2, 3, 4, 5, 6, 7, 8, 9, 10, 11, 12 or more moods or 1-15 moods, or 2-10 moods or 3-8 moods or 4-6 moods for at least 1, at least 2, at least 3, at least 5, at least 10, at least 50, at least 100, or at least 1000 environments. These moods may be created for 1 or more e.g., 2-1000 or 5-500 or 10-100 users for an environment. Depending on the quantity of light fixtures in a space, as well as the various functions, the number and/or degree of differentiation of light scenes might vary. Therefore, each setup is based on the circumstances of the environment and moods may be created based on rules such as those described in this specification or through one or more mood algorithms that incorporate these rules. Additionally, in some embodiments, the profile contains 1 to 10 or 1 to 5 or 2 to 5 or 2 or 3 or 4 static properties and each fixture has 1, 2, 3, 4, 5, or more controllable variables that affect illumination.

When the present invention is used to create a plurality of moods, for convenience, the moods may be referred to as a first, second, third, fourth, fifth, sixth etc., moods. The use of an ordinal reference does not denote a relationship among the moods or an order of use of them. Examples of moods include:

Energize Mood:

This mood is intended to energize a person. It creates an overall bright scene and thus instructs a plurality, if not all of the lighting fixtures, to have a brightness level of at least 80%, at least 90% or 100% (e.g., 80-100%) of their potential brightness. Further, the lighting fixtures may be used to light the overall and complete space or as much of it as is practical, and there is little contrast throughout the environment. This mood may also be referred to as a sunny day mood, or a get-ready for the day mood. When an RGB variable is an option for an energize mood, one or more, if not all of the fixtures may use colder to neutral whites with blue hues to mimic daylighting qualities. When dynamic white light is an option, one or more if not all of the fixtures, may exert 4000-5500 or 4000-5000 degrees Kelvin color temperature.

Work/Focus Mood:

This mood is intended to provide direct light in targeted zones of the room, e.g., functional areas such as tables. The brightness of work areas is approximately between 70-100% of its maximum while the ambient surrounding areas such as step lights and wall sconces play a less important role and thus would not be used or may be used in a range of 25-55% of their maximum brightness. Throughout the environment there may be a contrast in the lighting. Contrast refers to the delta or difference between different zones or light fixtures. It creates brighter and darker zones within a space to emphasize a certain area. Thus, there may be one or a plurality of areas that has localized lighting such as where the work areas are located and other areas that are more dimly lit or not lit e.g. periphery areas that are not actively used. The localized lighting may, for example, be by lights that are commonly associated with work areas such as desks e.g., downward directed table or floor lamps; or pendants or down lights while all indirect light sources are less important. When RGB or white light coloring is an option, in some embodiments, the instructions may direct some, if not all lights, to display relative cool color lighting, which refers to lighting that has, according to current circadian rhythm studies a wavelength of approximately 470-490 nm, e.g., approximately 480 nm in order to improve alertness. In some embodiments, when an RGB variable is an option, there is more neutral white light, and it can have red tones to increase alertness. When dynamic white light is an option, the lighting may be more neutral white around 3000-3500° K.

Lounge Mood:

This mood is intended to be consistent with lounging. The overall brightness of the environment is approximately 30%-50% of the maximum potential brightness for the environment. When the lighting fixtures permit, the instructions for the mood direct the creation of soft ambiance, which refers to lighting that has and makes use of warm and amber tones, contrast between different parts of the room, and indirect and ambient lighting.

Romance Mood:

This mood is intended to be consistent with a romantic setting. The overall brightness of the environment is approximately 10%-30% of the maximum potential brightness for the environment. The color hues typically used are deep blue/purple with amber golden highlights.

Night Mood:

This mood is intended to be consistent with an evening setting and to encourage persons to wind down. The overall brightness of the environment is approximately 10%-20% of the maximum potential brightness for the environment. For this mood, preferably warm white to amber hues are used.

Party Mood:

This mood is intended to be consistent with a party atmosphere. The overall brightness of the environment is approximately 35%-55% of the maximum potential brightness for the environment. For this mood, preferably bold, direct, primary colors such as red green and blue are used.

Relaxation Mood:

This mood is intended to be consistent with facilitating relaxation. The overall brightness of the environment is approximately 30%-40% of the maximum potential brightness for the environment. For this mood, preferably warmer hues and white are used.

TV Mood:

This mood is intended to be consistent with facilitating enjoyment of video programming. The overall brightness of the environment is approximately 15%-35% of its maximum potential brightness. For this mood, preferably colder white hues are used in order to match the coldness of colored TV screens.

Meeting Mood:

This mood is intended to be consistent with productivity among members of a group. The overall brightness of the room is approximately 80%-100% of its potential brightness. For this mood, preferably colder white and blues hues are used in order to create alertness.

Sexy Mood.

This mood is intended to be consistent with facilitating intimacy. The overall brightness is approximately 20%-40% of potential brightness of the room. For this mood, preferably red and purple tones are used for ambient fixtures.

One or more, e.g., a plurality of mood lighting scenes may be stored in a database for an environment. Additionally or alternatively one or more, e.g., a plurality, of baseline instructions for each fixture for each mood lighting scene may be stored in a database for either each environment or for all environments. These stored instructions may be referred to a pre-configured settings or light scenes and form base settings.

Environments

An "environment" refers to a location in which a set of lighting fixtures may be combined to create a mood lighting scene. The environment may, for example, be in a residential space, a hospitality space, a commercial space or an institutional space. By way of a non-limiting example, an environment may be a room, such as a bedroom, an office, a living room, a kitchen, a dining room, a foyer, a conference room, or a ballroom; a hallway; a cabin of a motor vehicle, such as a car, a truck, a boat and an airplane; a commercial setting such as a store; a movie theater; or a stadium. Further, an environment may be inside or outside. Moreover, an environment may be one room or a plurality of rooms.

For any environment there may be n fixtures, some or all of which are the same fixture type, e.g., table lamp. For example, n may be 1 to 1000, or 1 to 100, or 1 to 50, or 1 to 10, or 2 to 10, or 2 to 20, or 3 to 20, or 3 to 10, or 5 to 10. In some embodiments, for any environment in which there is a plurality of fixtures, at least two of the fixtures are different fixture types. In some embodiments, for any environment in which there are at least three fixtures, at least three of the fixtures are different fixture types. In some embodiments, for any environment in which there are at least five fixtures, at least five of the fixtures are different fixture types.

In some embodiments, for any environment in which there is a plurality of fixtures, at least two of the fixtures are the same fixture type. In some embodiments, for any environment in which there are at least three fixtures, at least three of the fixtures are the same fixture type. In some embodiments, for any environment in which there are at least five fixtures, at least five of the fixtures are the same fixture type.

Fixture Types

In various embodiments of the present invention, during a commissioning process, a central processing unit receives a profile for each fixture within an environment. The profile, which comprises at least one static feature, e.g., a fixture type may be represented by A. When A is a fixture type, A may, for example, be selected from the group consisting of down light, table light, wall sconce, floor lamp, pendant, up light, step light and strip light. A person of ordinary skill in art will recognize that this set of lighting fixtures could be larger or smaller and that a fixture type may be affirmatively selected or contained within or able to be derived from a different static property that is part of the profile.

In some embodiments, each of these lighting types may independently be defined by one or more, if not all, of the following static properties: (1) a glow value, which refers to the outward omni-direction of the light coming from the source unrestricted or from multiple sides or only channeled through a diffuser to create an even output and may be measured in terms of lumen output or by visual criteria; (2) an indirect lighting feature, which refers to an indirect light source in which the light source is shielded and then directed to reflect from another surface and may be measured in terms of lumen output; (3) reflective value or other visual parameters, which refers to an indirect or reflective lighting that can be directed in certain directions and can be subdivided as up or downward directed reflective or indirect lighting; (4) a direct or task light/spotlighting value, which refers to a targeted light source in which the light is shielded or directed towards one direction. Additional static features that may be considered include but are not limited to, a quantity of fixture type, room type, geographic location of the room and time of year.

Each fixture type has an optimal setting or set of settings when one seeks to produce a mood/scene within a specific range of dynamic states. Each fixture type can be assigned a range of ideal dynamic states relative to the set of possible moods/scenes. The range of ideal dynamic states for each fixture type can be referred to as the range of base settings for the fixture type and a specific base setting may be assigned for each mood or for each mood for each user. The variable property may be used to control and to implement the dynamic states through the assignment of one or more illumination values as appropriate.

The absence of a particular static property for a fixture type as described below means that although the reference file has a value for that fixture type, that static property may not be relevant or not considered.

When considering the illumination value, e.g., brightness of a bulb within a fixture, a person of ordinary skill in the art will recognize that the wattage of a light bulb cannot always be manipulated but rather is a physical provided property by the light bulb itself. The algorithms may assume an average wattage of for example, the maximum wattage recommended for the fixture or a fixed percentage of it, e.g., 65% to 80%, e.g., 65%, 70%, 75% or 80% or measures certain lumen output and wattage during the commissioning process, i.e., collects data relating to the physical bulb properties. Similarly, empirical information may also be collected with respect to color output if the bulb allows for color-changing (i.e., has the ability to vary the color output through for example, RGB values, Kelvin measurements, a combination thereof or other means).

Additionally, persons of ordinary skill in the art will recognize that when comparing various manufacturers to one another, even though they might list the same wattage of their products, the light output may not be the same. If such a difference exists and is recognized or measured, then when applying the present invention to technology from manufacturer A one might need to decrease or to increase brightness by a factor of for example, up to 10% as compared to manufacturer B in order to equalize the light output. If such a circumstance is present, this increase or decrease may be included in a mood algorithm. In one embodiment, the formula to adjust is: Sum ([F×D×P]×"brighter" manufacturer/"dimmer" manufacturer in lumen output)=equalized Mood. F stands for fixture type; D stands for illumination type or direction and P stand for fixture property such as on-off/dim value or RGB.

In some embodiments, after an actual wattage or lumen output has been collected, the algorithm will adjust from the average baseline and either increase or decrease the percentage output accordingly to account for differences between the wattage used and the wattage assumed in the baseline. As described in more detail below, there are options for users to customize mood settings, and thus, if in an environment a user encounter bulbs with higher or lower wattages than the user is used to or than would evoke the mood for that user, the user can customize a scene and set of instructions for one or more moods.

A "down light" or "downlight" or "DL" refers to a light source that is facing downward and is typically located inside a space on horizontal surface such as a ceiling. A down light can have a glowing parameter in which the light is omni-direct or it is an indirect light source where the light source is shielded and then reflected or it is a direct facing output in which the beams are all bundled toward a direction. Typically a glowing fixture has higher light output than an indirect light source, while a directed light source has maximum brightness only in a certain direction, and in others directions is not relevant.

A "table light" or "TL" refers to a light such as a lamp that sits on a table. A table lamp can be glowing and emit omni-direct lighting or it can be directed to illuminate a table or region of a room. A table light can also have directed, bundled lighting that is good for all task oriented activities such as focus or work. This light output is, when directed, the brightest of all, but only in a certain direction.

A "floor lamp" of "FL" refers to a light that is typically free standing and standing on a horizontal surface in a lower part of the room such as the floor. A floor lamp can be glowing and emit omni-direct lighting and in some embodiments, its glow value corresponds to its highest light output. Floor lamps can also have indirect reflected lighting. In these cases, the light is directed toward another surface such as the floor or the ceiling. Upward directed lighting provides more overall higher level illumination, which is good for moods such as an energize mood, while a lower level indirect lighting is good for moods such as late night romance moods. Indirect lighting has typically the least light output, and the illumination values typically need to be increased to have the same impact as a comparable glowing light fixture type.

A "wall sconce" or "WS" refers to a light fixture that is attached to a wall and often is used for decoration and/or to define the periphery of a room. The omni-directed glowing wall sconce has the brightest light output, and values need to be decreased compared to an indirect wall sconce where the light output is reflected and directed over another surface. This has a low level of light output and in relation to other light sources needs to be increased to create a comparable brightness. A directed light sconce has the highest brightness in a certain direction while in the other directions its brightness is typically very low.

A "pendant light" or PL refers to a light fixture that is mounted on a horizontal surface in the upper part of a room or above a person's eye level. It typically provides more general illumination as it sits high and brings lighting onto the ceiling.

An "up light" or "uplight" or "UL" refers to lighting that is located at a horizontal surface within a room and illuminates up toward the space. Often it sits below eye level either inside the floor or surface mounted on top of it or on a ledge. It may be used to punch up to the periphery or ceiling in a room if a significant amount of power is used. In some rooms, one may find this type of lighting along the periphery of one or more walls in order to highlight textures or specific elements.

A "step light" or "SL" refers to lighting typically located inside a vertical surface. It is more common in commercial applications or in non-commercial applications along stairs and corridors.

A "strip light" or "ST" is a linear light source and refers to lighting that has a variety of functions and may be integrated in an architecture of furniture in order to provide ambiance and indirect lighting. It may, for example, be located at floor level or inside a ceiling or along a counter.

Optionally, a user may add a new type of fixture e.g., new fixture types that are being developed are area or volume lights that have an omni-glowing character over a flat surface area. In these cases, the parameters may be defined by default values until a user sets or adjusts them. The default values may, for example, be the values of any of the other fixture types, and if one of those settings is used, then preferably it is one in which the intended function of the light is similar.

Preferably, each fixture also has a unique identifier and the ability to receive instructions from a controller and/or server and/or CPU (central processing unit) and to implement those instructions. Thus, each fixture may comprise or be coupled to a computer chip and a power source. Additionally, each fixture may independently be in wired or wireless communication with the controller and/or server and/or CPU that implements a method of the present invention.

Significance of Fixtures for Mood Scenes

In some embodiments, the fixture types may be categorized as follows:

A=typical Ambient light sources=DL, PL, UL, SL, ST. Ambient lights create general brightness and ambiance.

D=typical Decorative light sources=FL, TL, WS, ST. Decorative lights create more localized lighting.

One may also categorize the types of fixtures in terms of location in the room by, e.g., height with a dividing line between 3 feet and 4 feet, e.g., 3 feet or 4 feet off of the ground. The set of light fixtures more than 4' high=DL, PL, WS, TL, ST. These fixtures create more general brightness and ambiance. The set of light fixtures less than 4' high=UL, SL, FL, ST. These fixtures create more localized low level lighting.

These lighting classifications may be used to influence the determination of the lighting scene default values and outline rules. Thus, they allow for varying from a model set of illumination values based on what is available for an environment. Accordingly, if the preferred lighting and illumination types are not available, then the use of the less relevant or preferred lighting may be increased. In some embodiments, adding new lights can shift the relationships and increase or decrease brightness values according to outlined principles below:

Energize: use and more emphasis of: (1) lights above 4'; (2) more glow or direct lighting, (3) more ambient and evenly distributed lighting preferred and (4) cooler color palette. Unless the other lights do not exist in the space, less relevant are lights below 4 feet and indirect lights.

Focus or Work: use and more emphasis of: (1) more direct lighting; (2) lights above 4'; and (3) lights with overall brightness with some contrast. Unless the other lights do not exist in the space, less relevant are lights below 4 feet and indirect lights.

Lounge or relax: use and more emphasis of: (1) more indirect and lighting above; (2) balance between >/<4' lights and (3) warmer color palette. Unless the other lights do not exist in the space, less relevant is direct light.

Romance: emphasis and use is more of: (1) lights below 4 feet; (2) more localized and decorative lighting; and (3) more indirect lighting. If possible one avoids ambient or <4' (any DL: no, PL: minimize, WS: little to none).

Controllable Variables

Each fixture will have one or more controllable variables. A controllable variable is a variable that allows for a change in the light (brightness and or color or other characteristic) illuminating from a fixture at the direction of a CPU, server or controller.

In the simplest case, a fixture may be able to be turned on and off. Thus, there is an on/off variable. Other controllable variables include but are not limited to a brightness level, which corresponds to a dimmable fixture, an RGB or RGBW value, which refers to a color changing fixture; and a color value for dynamic white lighting, which may be measured in the range of 2000K to 8000K. Any one or more of these controllable variables may be relevant for and associated with any one or more of the static properties of the fixture types described above.

At a minimum, each fixture has a maximum illumination value, which may be referred to as $B_x$. For a fixture that has an on/off variable, the $B_x$ is the brightness level when the light is in an on state. Thus, each fixture regardless of the mood, may be defined by $(A,B_x)$, wherein A=a fixture type, and $B_x$=maximum illumination value.

For each mood lighting scene each fixture will also has a $B_{x'}$. $B_{x'}$=implementation illumination value. $B_{x'}$ Thus, $B_{x'}$ is specific for a mood for an environment and each fixture for each lighting scene may have an implementation profile that may be represented by $(A,B_{x'})$ and the set of implementation parameters for a scene for an environment may be represented by $(A,B_x)_m$ for each of 1 to n fixtures.

If there is a plurality of mood lighting scenes, each may be represented by $(A, B_{x'})_{n,m}$ for each of 1 to n fixtures for each of 2 to m scenes.

Other static properties to which controllable variables may be applied may be represented as follows: $B_y$ maximum light in an up direction; $B_z$ is the maximum light in a directed direction and B is the maximum light in a task oriented orientation. Similarly $B_{y'}$ is the implementation light in an up direction, $B_{z'}$ is the implementation light in a directed direction and $B_{a'}$ is the implementation light in a task oriented orientation. These values may be expressed in terms of absolute numbers or relative numbers or percentages.

Additionally, for a property, for each mood there may be an implementation value that corresponds to one or a plurality of controllable variables. For example, implementation values may comprise the brightness of the light and the RGB value or other color value, or an on/off instruction and an RGB value or other color value. Thus, $B_x$ could be a single value or a plurality of value to apply to a plurality of controllable features.

Commissioning of a Mood Lighting Scene

In order to generate a mood lighting scene, a request to generate that scene is received. It may be received from a user, an administrator or from a CPU itself upon initiation of an application. This may be done for a new environment, or for a different set of devices for an environment. In order for a scene to be displayed in an environment, first a commissioning process must be undergone. Thus, first a set of fixtures is defined and each fixture has a profile that identifies a static feature such as a fixture type and optionally a set of one or more additional static properties of the fixture. As persons of ordinary skill in the art will recognize, although the ability to be controlled by a controllable does not change, how the controllable variable is implemented may change for each mood scene. Thus, whether a fixture has the ability to be switched or dimmed, or it has color changing abilities or the ability to exhibit light shifting is a feature of the fixture, but how those features are implemented is defined by a controllable variable.

The profiles may be received in any one of a number of ways. For example, an individual can visit an environment, determine the types to assign to each fixture and then transmit that information and optionally other information, such as room size, location of each fixture in the room, natural light, and orientation of the room. The fixture type may include the capabilities of the light, e.g., it is dimmable or only on/off, and if applicable, it has color capabilities and, if so, what kind. The profiles may be input through a prompted guide. The guide may, for example, be accessible through an application that resides on a local device or in a cloud, and is accessible through a personal computer or personal computing device. Optionally, the personal computer or personal computing device can directly or through a relay access data from which to obtain base settings for the fixtures in the environment for one or more moods.

In some embodiments, the user inputs the fixture type or its static parameters plus a mapping of the location or a unique identifier, and the system accesses one or more databases that contain static properties of the fixture. The automated mapping technologies may including but are not limited to taking photos that are analyzed or importing mapped data such as lighting plans and fixture specifications. Alternatively, the user may input the relevant properties into the system. Still further, in other embodiments, there is a bar code or QR code or other code on each device and the user takes a picture of the code and transmits that code to the relevant central processing unit, which accesses a database that contains the static and variable properties.

For each device within an environment, a set of implementation instructions is generated such that the combined set of implementation instructions for the set of fixtures for the environment creates a desired mood and when implemented form the mood lighting scene. Generation may be by any of the following methods or combinations thereof.

First, a computer processing unit, after receiving the profiles parameters for the set of fixtures for the environment, can either wait for a request for a specific mood lighting scene for that environment or initiate creation a set of default mood lighting scene profiles for that environment based on the identified fixtures.

When a request for a mood setting is received, the CPU may access a database of stored mood lighting scenes, and if one is accessible, implement those instructions. Alternatively or if no applicable mood lighting scene is stored, the CPU may execute an algorithm in order to generate a set of instructions for the requested mood lighting scene or to form a base set of mood lighting scene instructions for one or more moods such as those identified above.

In some embodiments, the process begins by accessing baseline instructions for each of the fixtures for a particular a mood scene. Thus, these baseline instructions may be predefined. For example, for each of the fixtures that has only an on/off parameter, the configurations in table 1 below may be used for the scenes identified therein. Note that the percentages in the second row refer to general brightness that is obtained through a combination of lights being on or off. The percentages for general brightness are non-limiting examples, but show how combinations of lights being on and off can lead to general brightness levels. In some embodiments, (and in all tables other than the "ON" column in Table 1) each percentage given may be used or independently in other reference tables one may use a percentage within a range that is defined by the recited number of the tables presented herein being the center or upper or lower end of the range. These ranges may span by, for example, up to 20 percentage points or 10 percentage points or five percentage points or two percentage points in either one or both directions from those listed but no higher than 100% or lower than 0%.

TABLE 1

| Lights that only have On/Off Switching Capabilities<br>LIGHT SCENES - PRE-CONFIGURATION STANDARD TABLE FOR PRESET LIGHTING SCNES* | | | | | | |
|---|---|---|---|---|---|---|
| LIGHT FIXTURES TYPE | | ON | SCENE 1: DAY: SUNNY/ ENERGIZE/ GET-READY general brightness level: ~100% ON/OFF | SCENE 2: WORK/ FOCUS general brightness level: ~60% ON/OFF | SCENE 3: RELAX/ LOUNGE general brightness level: ~40% ON/OFF | SCENE 4: NIGHT/TV general brightness level: ~20% ON/OFF |
| 1 DOWN LIGHT | GLOW | 100% | ON | ON | OFF | OFF |
| | DOWNWARD OR DIRECT | 100% | ON | OFF | ON | OFF |
| 2 TABLE LIGHT | GLOW | 100% | ON | ON | ON | ON |
| | DOWNWARD OR DIRECT | 100% | ON | ON | ON | ON |
| | INDIRECT OR UPWARD | 100% | ON | OFF | ON | ON |
| 3 WALLSCONCE | GLOW | 100% | ON | OFF | ON | OFF |
| | DOWNWARD OR DIRECT | 100% | ON | ON | ON | OFF |
| | INDIRECT OR UPWARD | 100% | ON | OFF | ON | OFF |
| | UP & DOWN | 100% | ON | OFF | ON | OFF |
| 4 FLOOR LAMP | GLOW | 100% | ON | ON | ON | ON |
| | DOWNWARD OR DIRECT | 100% | OFF | ON | ON | ON |
| | INDIRECT OR UPWARD | 100% | ON | OFF | ON | ON |
| 5 PENDANT | GLOW | 100% | ON | ON | ON | OFF |
| | DOWNWARD OR DIRECT | 100% | ON | ON | OFF | OFF |
| | INDIRECT OR UPWARD | 100% | ON | OFF | ON | OFF |
| 6 UPLIGHT | GLOW | 100% | ON | ON | OFF | OFF |
| | DIRECT | 100% | ON | OFF | ON | ON |
| 7 STEP LIGHT | GLOW | 100% | ON | OFF | ON | OFF |
| | DIRECT OR DOWNWARD | 100% | ON | ON | OFF | ON |
| 8 STRIP LIGHT | GLOW | 100% | ON | OFF | ON | OFF |
| | DOWNWARD OR DIRECT | 100% | ON | ON | OFF | ON |
| | INDIRECT OR UPWARD | 100% | ON | OFF | ON | ON |
| | UP & DOWN | 100% | ON | ON | ON | OFF |

For any fixture for which there is RGB variability and white light color temperature measured in Kelvin, the parameters identified in Table 2 may be used for the scenes identified therein. If only one RGB variable or dynamic white light variable is possible, then only the applicable information from the reference data file will be used. Note that both the color components and the percentage of brightness of light in the direction are provided.

In Table 2, the A in the second column refers to ambience, and the D in the second column refers to decorative lighting.

TABLE 2

| Light Fixtures that have Color Changing Abilities | | | | | | |
|---|---|---|---|---|---|---|
| LIGHT FIXTURES TYPE | | | SCENE 1: DAY: SUNNY/ ENERGIZE/ GET-READY Brightness~100% RGB | SCENE 2: WORK/FOCUS Brightness~60% RGB | SCENE 3: LOUNGE Brightness~40% RGB | SCENE 4: ROMANCE Brightness~15% RGB |
| 1 | A DOWN LIGHT | GLOW | CW - 90% | W - 30% | A - 30% | 0% |
| | | DOWNWARD OR DIRECT | CW - 100% | CW - 40% | A - 40% | 0% |
| 2 | D TABLE LIGHT | GLOW | CW - 90% | W - 80% | G - 50% | O - 10% |
| | | DOWNWARD OR DIRECT | CW - 100% | CW - 90% | WW - 60% | G - 35% |
| | | INDIRECT OR UPWARD | W - 100% | WW - 60% | G - 60% | B - 50% |

TABLE 2-continued

| Light Fixtures that have Color Changing Abilities | | | | | | |
|---|---|---|---|---|---|---|
| | LIGHT FIXTURES TYPE | | SCENE 1: DAY: SUNNY/ ENERGIZE/ GET-READY Brightness~100% RGB | SCENE 2: WORK/FOCUS Brightness~60% RGB | SCENE 3: LOUNGE Brightness~40% RGB | SCENE 4: ROMANCE Brightness~15% RGB |
| 3 | D WALLSCONCE | GLOW | W - 90% | W - 30% | A - 40% | O - 15% |
| | | DOWNWARD OR DIRECT | W - 100% | CW - 50% | G - 50% | G - 30% |
| | | INDIRECT OR UPWARD | CW - 70% | WW - 30% | O - 60% | B - 30% |
| | | UP & DOWN | CW - 60% | WW - 40% | A - 70% | A - 30% |
| 4 | D FLOOR LAMP | GLOW | W - 80% | W - 50% | A - 50% | O - 30% |
| | | DOWNWARD OR DIRECT | W - 90% | CW - 90% | G - 60% | G - 30% |
| | | INDIRECT OR UPWARD | CW - 80% | WW - 70% | A - 70% | B - 30% |
| 5 | D PENDANT | GLOW | W - 70% | W - 60% | A - 40% | O - 20% |
| | | DOWNWARD OR DIRECT | W - 90% | CW - 80% | WW - 50 | G - 20% |
| | | INDIRECT OR UPWARD | CW - 50% | WW - 30% | O - 60% | B - 25% |
| 6 | A UPLIGHT @ Floor | GLOW | CW - 80% | WW - 40% | O - 50% | O - 35% |
| | | DIRECT | CW - 90% | W - 60% | A - 80% | G - 25% |
| 7 | A STEPLIGHT | GLOW | CW - 80% | WW - 20% | A - 30% | O - 20% |
| | | DIRECT OR DOWNWARD | CW - 100% | W - 50% | G - 40% | G - 25% |
| 8 | A STRIPLIGHT | GLOW | CW - 80% | W - 30% | G - 60% | O - 15% |
| | | DOWNWARD OR DIRECT | CW - 90% | CW - 60% | G - 50% | G - 20% |
| | | INDIRECT OR UPWARD | W - 100% | WW - 40% | O - 70% | B - 45% |
| | | UP & DOWN | W - 90% | W - 40% | A - 60% | B - 30% |

For any fixture for which there is dimmable variability, the parameters identified in table 3 may be used for the scenes identified therein.

TABLE 3

| Light Fixtures that have Dimming Capabilities | | | | | | |
|---|---|---|---|---|---|---|
| | LIGHT FIXTURES TYPE | | ON | SCENE 1: ENERGIZE (DAY: SUNNY/ GET-READY) General brightness level: ~100% DIM | SCENE 2: FOCUS (WORK) General brightness level: ~60% DIM | SCENE 3: RELAX General brightness level: ~40% DIM | SCENE 4: NIGHT General brightness level: ~20% DIM |
| 1 | DOWN LIGHT | GLOW | 100% | 90% | 30% | 20% | 5% |
| | | DOWNWARD OR DIRECT | 100% | 100% | 40% | 30% | 5% |
| 2 | TABLE LIGHT | GLOW | 100% | 90% | 80% | 30% | 10% |
| | | DOWNWARD OR DIRECT | 100% | 100% | 90% | 45% | 30% |
| | | INDIRECT OR UPWARD | 100% | 100% | 60% | 30% | 20% |
| 3 | WALLSCONCE | GLOW | 100% | 90% | 30% | 40% | 5% |
| | | DOWNWARD OR DIRECT | 100% | 100% | 50% | 50% | 10% |
| | | INDIRECT OR UPWARD | 100% | 70% | 30% | 70% | 20% |
| | | UP & DOWN | 100% | 60% | 40% | 60% | 10% |

TABLE 3-continued

| Light Fixtures that have Dimming Capabilities | | | | | | |
|---|---|---|---|---|---|---|
| LIGHT FIXTURES TYPE | | ON | SCENE 1: ENERGIZE (DAY: SUNNY/ GET-READY) General brightness level: ~100% DIM | SCENE 2: FOCUS (WORK) General brightness level: ~60% DIM | SCENE 3: RELAX General brightness level: ~40% DIM | SCENE 4: NIGHT General brightness level: ~20% DIM |
| 4 FLOOR LAMP | GLOW | 100% | 80% | 50% | 30% | 10% |
| | DOWNWARD OR DIRECT | 100% | 90% | 90% | 40% | 30% |
| | INDIRECT OR UPWARD | 100% | 80% | 70% | 50% | 20% |
| 5 PENDANT | GLOW | 100% | 70% | 60% | 20% | 10% |
| | DOWNWARD OR DIRECT | 100% | 90% | 80% | 30% | 20% |
| | INDIRECT OR UPWARD | 100% | 50% | 30% | 50% | 5% |
| 6 UP LIGHT | GLOW | 100% | 80% | 40% | 40% | 20% |
| | DIRECT | 100% | 90% | 60% | 70% | 20% |
| 7 STEP LIGHT | GLOW | 100% | 80% | 20% | 30% | 20% |
| | DIRECT OR DOWNWARD | 100% | 100% | 50% | 40% | 10% |
| 8 STRIPLIGHT | GLOW | 100% | 80% | 30% | 60% | 20% |
| | DOWNWARD OR DIRECT | 100% | 90% | 60% | 40% | 10% |
| | INDIRECT OR UPWARD | 100% | 100% | 40% | 70% | 40% |
| | UP & DOWN | 100% | 90% | 40% | 60% | 20% |

Table 4 provides a key for tables 1-3. For RGB values, the numbers provided are examples. In some embodiments, those numbers vary by up to 20 in either one or both directions (but not lower than 0 and no higher than 255) and those numbers are representative of the ranges that include those variations.

TABLE 4

| Color Key | | |
|---|---|---|
| Color matrix | Code | RGB VALUE |
| Cold White | CW | 255/209/190 |
| Neutral White | W | 255/218/165 |
| Warm White | WW | 255/174/93 |
| Amber | A | 255/160/60 |
| Golden | G | 255/180/50 |
| Yellow | Y | 255/168/0 |
| Orange | O | 255/144/2 |
| Blue | B | 70/0/255 |
| Red/Magenta | R | 255/61/56 |
| Red 2 | R2 | 255/85/31 |
| Pink | PK | 255/3/180 |
| Purple | P | 135/26/255 |
| Green | GR | 0/255/80 |

For any given environment, there may be more than one of the same type or types of fixtures and/or there may be fewer than all of the types of fixtures. In some embodiments, the instructions in each table for any applicable scene are used and not modified regardless of the absence of certain types of fixtures and/or the presence of two or more of the same types of fixtures or any other static properties.

In other embodiments, if there is a plurality of the same types of fixtures, e.g., lamps or wall sconces, the instructions will not be revised and the fixtures will be treated as a group unless they are configured as off and no other light fixture is in the space; and then their default value for dimmability will move to 10% and for on/off would move to on and for a color value to a neutral color.

In some embodiments, for each fixture A there is a controllable variable of one or more of an RGB color value, a color temperature, a dimmable state, and an on/off state. In some embodiments, for a plurality or for each fixture A there is a controllable variable of two or more of an RGB color value, a color temperature, a dimmable state, and an on/off state, e.g., RGB color value and color temperature; RGB color value and dimmable state; RGB color value and an on/off state; color temperature and dimmable state; color temperature and on/off state and dimmable state and on/off state. In some embodiments, for a plurality or for each fixture A there is a controllable variable of three or more of an RGB color value, a color temperature, a dimmable state, and an on/off state, e.g., RGB color value, color temperature and dimmable state; RGB color value, color temperature and on/off state; RGB color value, dimmable state and on/off state; and color temperature, on/off state, and dimmable state. In some embodiments, for a plurality or for each fixture A there is a controllable variable of all four of an RGB color value, a color temperature, a dimmable state, and an on/off state.

After a set of instructions for a mood for an environment is generated, it may, for example, be stored in a data file.

In some embodiments, settings for at least three mood lighting scenes are created, $m_1$, $m_2$, and $m_3$, wherein for $m_1$ the scene implementation parameters when implemented combine to provide overall brightness of at least three times the overall brightness of $m_3$; and for $m_2$ the scene implementation parameters when implemented combine to provide overall brightness less than $m_1$ but at least two times the overall brightness of $m_2$. In some embodiments, there are at least four mood lighting scenes are created, $m_1$, $m_2$, $m_3$, and $m_4$, wherein for $m_1$ the scene implementation parameters when implemented combine to provide overall brightness of at least four times the overall brightness of $m_4$; for $m_2$ the scene implementation parameters when implemented combine to provide brightness less than $m_1$ but at least three times the overall brightness of $m_4$, and for $m_3$ the scene implementation parameters when implemented combine to provide overall brightness less than $m_2$ but at least three times the overall brightness of $m_4$.

Supplemental Fixture Characteristics

Optionally, each fixture may be defined by one or more supplemental static fixture characteristics. Examples of these supplemental static fixture characteristics include:

C, wherein C=a mounting location selected from the group consisting of floor, wall above a specific height, e.g., 3' or 4' or wall below a specific height, e.g., 3' or 4', ceiling, submersible and table;

D, wherein D=a room type selected from the group consisting of living room, bedroom, kitchen, bathroom, outdoor, dining, office, lobby and utility, with for example, shifting brightness and color values based on the intended use of the room; and E, wherein E=a space characteristic selected from the group consisting of size, color, daylight, furniture, style, materials, finishes, windows, user's culture, and user's age, with for example, shifting brightness and color value based on how characteristics of the room inherently, add to or take away from the effect of illumination values or how a demographic characteristic or age biases a person to want brighter or less bright light or light emphasized or deemphasized by taking away from certain color effects.

These supplemental fixture characteristics may be used to distinguish two or more fixtures within an environment that are the same fixture type and to modify instructions in any table by increasing the lumen output or brightness or color settings and decreasing brightness/lumen output or color values for C, D. or E. By way of a non-limiting example, certain cultures prefer more colors in their lighting because that is what they typically use. In these cases, instructions may be adjusted to include different RGB values or other color values where possible.

Uses

After a mood lighting scene has been established and the fixture has been commissioned, a subsequent user may request implementation of the mood lighting scene. After receiving a request, a computer or controller may: (i) access a stored set of scene implementation parameters for the fixtures within an environment, wherein the stored set of scene implementation parameters are stored in a database; and (ii) retrieve the stored set of scene implementation parameters for each of the fixtures in the scene.

The computer may then cause the instructions to be sent to the relevant fixtures. The fixtures then implement the instructions to create the mood lighting scene. Thus, each fixture that was off or in a mode other than that which is the same as in the instructions will change to the mode of the instructions and, thus, change the illumination configuration in the environment.

Optionally, during or prior to sending the instructions, the computer receives or retrieves demographic information about a user including but not limited to one or more of age, sex, cultural background, geographic location and nationality. Thus, in some embodiments, there is adjusting of at least one of the stored set of scene implementation parameters to form adjusted scene implementation parameters, wherein said adjusting is an increase or decrease of at least one of $B_x$, $B_y$, $B_z$, and $B_a$, for at least one A and the instruction that is transmitted comprises the adjusted scene implementation parameter(s). Prior to implementing the mood lighting scene, the computer may, for example, adjust the instructions as follows:

As someone ages, he or she needs more light. Thus, when someone is older, the light levels may, e.g., be increased by 20-30% depending on his or her eye sight.

Additionally, there are studies that suggest that females are more attuned to subtle color differences in light. Thus, when a woman is the primary user, color values may be adjusted accordingly in one direction or alternatively, when a man is the primary user, color values may be adjusted accordingly in the other direction.

For geographic locations, the stored parameters may be adjusted according to the amount of daylight for the location in terms of the direction of windows and/or how much daylight the location gets, e.g., considering latitude and time of the year. By way of a non-limiting example, at different times of the year, Scandinavian countries have partial or no sunlight or sunlight almost 24/7. Adjustments may be made to decrease the brightness when there is increased sunlight.

In other embodiments, the geographic location can also be used to infer which cultural preferences to apply.

If any implementation parameters are adjusted for a particular user, the system may be able to pull this information data from the users phone and location profile and be configured to store these adjusted parameters so that future calculations can be avoided.

Additionally or alternatively, adjusting may be dependent on user observed behavior or environmental changes. Examples of environmental changes include but are not limited to how the location changes in relation to the sun or other changes such as guests visiting or personal preferences.

User Override

Optionally, the various embodiments of the present invention allow for user override. A user override is a circumstance in which a user actively changes the implementation of instructions generated by the methods or systems of the present invention. User override may, for example, be through transmitting data through a wireless or wired communication. Alternatively, it may be through the physical manipulation of a device, wherein there is a sensor on or affiliated with the device that allows for detection of the change. Still further, in other embodiments, the user override is the receipt of instructions from a user or sensors or prior stored preferences.

A user override may be stored for the particular user for a particular environment such that when the user selects a mood for that environment, the user's specific set of implementation parameters are invoked. A user override may be for a specific room or it may be for any environment for which the user has control. For example, if a user initiates an override to implement more amber light within a romance setting in a room than the amount of light for which the pre-configured setting calls, the user may be provided with the option of having all romance settings increase their amber light whenever that user invokes a romance mood, regardless of the environment.

Changing Moods

The methods and systems may be used to implement different moods within an environment. Thus, a user may transmit a first request for a first mood lighting scene and subsequently transmit a second request after sending the first request thereby causing the system to generate instructions for a second mood lighting scene. The system will then transmit instructions for the second mood lighting scene to the fixtures and cause them to cease implementing the first mood lighting scene and generating the second mood lighting.

Through a portable communication device or any other computing device, a user of the system can select any of the preconfigured scenes with the touch of a button or touchscreen. When she wants to change scenes, she can simply press another button or touchscreen and all of the lights in the system simultaneously transition to the new scene. These scenes can be pre-loaded onto the system and may not require a manual setup. This can allow for quick and easy access to meaningful lighting atmospheres and moods. Whereas known systems that can include limited light scene capabilities assign all of the same white or one color hue settings to all fixtures, or they upload a photo and then randomly pick some colors and assign them randomly to a light fixture, the disclosed systems and methods use an informed process of logical light scene generation.

In various embodiments, a user can also schedule the scenes to occur at various times of the day, week, or on a specific date, or set light scene changes up through automatic learning behaviors and pattern recognition.

Motion Detectors

Optionally, an environment may contain a motion sensor, ibeacon or occupancy/vacancy sensors or any other location aware technologies that detect when a person enters or leaves a room or when there has been no movement in the room for a predefined amount of time, e.g., 15 minutes, 30 minutes, 1 hour or 2 hours. If the motion detector does not detect motion or detects no motion within a predetermined time period, the system may shut off all lights or return to a default or hibernation mode that keeps on a minimum set of preselected lights.

User Interfaces

A user may interface with the systems of the present invention through an app on his or her telephone, smartphone, tablet or any type of scene button switches or remotes, a mainframe, a networked computer or other computing device. The device may be part of, in communication with or capable of being in communication with, a computer that is capable of automating the methods described herein.

Thus, upon launching an app or computer program product that can access the database, or visiting an appropriately designed website, a user may begin the process of setting mood lighting scenes for an environment. The user may be required to show access privileges such as login credentials or scanning or typing in a provided code or otherwise demonstrate that he or she is entitled to access a computer program product that enables him or her to set-up and/or use a mood lighting scene in the environment. Thus, the user may need to have or to acquire a user name and password, or as in a hotel embodiment, scan in a QR code or click on a link or enter an access code.

The user may then define an environment either by creating a new environment or selecting from a set of pre-established environment descriptors. Alternatively or additionally, the user may then be presented with the opportunity to define the set of light fixtures for the environment by the fixture type, which is a static property of the light fixture. This may be accomplished by the selection of fixture type from a menu or set of icons that are presented through a graphic user interface. Alternatively, it may be accomplished through inputting data that identifies the fixture, e.g., through a prompt in which a user types in identifying information, selection from a drop down menu, selection from a set of icons, transmitting an image of a fixture, or transmitting an image of a bar code, QR code or serial number associated with a fixture.

Each fixture may also be defined by an address through which data may be received. This information may be input through e.g., a prompt in which a user types in identifying information, selection from a drop down menu, selection from a set of icons, transmitting an image of a fixture or transmitting an image of a bar code, QR code or serial number associated with a fixture.

The system may then automatically create data packets that comprise instructions for the lighting fixtures within the environment for one or more mood lighting scenes without further input from the user. That user or subsequent users may be presented with the options of selecting a mood lighting scene through, for example, a graphic user interface. When the system receives that request, it may then transmit the request to the light fixtures, which will automatically execute them.

The system may be configured either to transmit a complete set of instructions to each light fixture or to transmit only the relevant instructions to each light fixture.

In various embodiments, when a user selects a preconfigured mood, the duration of the activated mood can be recorded. The specific adjustments that the user makes to the base settings of the dynamic states of the fixtures when each mood is activated can also be recorded. Mood usage and adjustments to the dynamic states of each fixture can be correlated with the static states and environmental states of each fixture to generate a user profile.

In various embodiments, the overall user base of the application can be sorted first by the environmental states of their fixtures and then grouped into sub-groups by the static states of their fixtures. The adjustments that each user has made to the base settings of the dynamic states of each fixture can then be compared and contrasted within the sub-groups to find both the average deviation and outlier deviations from the base settings. These values can then be compared against the general distribution of values of the base settings, and adjustments can be made to the base settings relative to the distribution of adjusted user settings.

Learning Algorithm

In various embodiments, the present invention comprises a learning algorithm that is designed to analyze use of the system over time and adapt lighting automatically to users' activities, preferences and needs within a space. As users modify a scene to their personal preferences or add new scenes, the information may be stored in a database or used to adjust the lighting behavior, e.g. cloud coverage leads to light settings to increase brightness by 5-30% depending on remaining daylighting.

Learning may be through a feedback loop and the automatic triggers of manual presets, scheduled scenes, location, and behavior tracking to create the existing light setting selection. This information can be relayed through the server or to another controller, such as a smartphone or tablet to the physical lights. As conditions change, and lighting adjustments are made, the server can relay information about the changing lights to the analytics engine, which applies the changing information to create a new light setting selection. The light setting selection can automatically update the user interface, and can be relayed to the physical lights.

In some embodiments, the process can loop continuously, with the server constantly feeding current lighting conditions to the analytics engine and modifying the scenes and scheduling of the scenes to optimally utilize the system. In some embodiments, the analytics engine can automatically adjust the system to a user's activity, and minimize the need for user interactivity with the system. Over time, the system can learn to predict a user's behavior based on pattern recognition, and can help control the lights with minimal interaction by the user.

Learning may be through empirical observation or through, for example, the receipt of demographic information.

Applying the Learning Algorithm to Others

In various embodiments, several users can be granted authorization for several environments. As information is collected about each individual user, the system can modify that user's base settings and light setting selection accordingly.

This information can also be gathered and analyzed for all users of the system collectively. As each user of the system adjusts scenes and makes changes to her space, the system can collect that information and modify base settings going forward when granting authorization to new users and setting up new systems to better serve the users of other lighting systems.

Information about the user, including age, culture, region, etc., can be included with base settings and individual preferences. The analytics engine can apply user information with the feedback from a similar user's activity to optimally adjust scenes and scheduling for each user.

Presence and Hierarchy

Multiple devices and multiple people may acquire access to the same room or space control and the lighting system. In some embodiments, a hierarchy of user privileges can be outlined, or the system can direct that the most recent input from a device overrides the previous settings, and controls the lighting at that moment. When multiple users have authorization for the same system, a hierarchy of users may be accessed to determine which lighting settings apply. Examples of the hierarchy include but are not limited to parent over child or hotel manager over guest.

Based on the presence of a portable communication device for advanced settings, the system can be aware when a particular user is in a space. When a user is present, she may control the system. She may adjust the system at that moment, or if she has scheduled certain lighting settings, those can automatically apply. When a different authorized user is in the space, the system can apply that user's settings, and the setting can define who can overrule the other user.

Additionally, each system can have the option of turning all lighting off when no user is present in the space, in order to conserve electricity. Thus, in some embodiments, there may be no need for motion sensors as the system can recognize the presence of users by communicating with their portable communication devices.

Additionally, a user can acquire authorization to control the lighting system in multiple spaces. When a user enters a new space, she can have access to the settings she applied in the previous space. Her preferences can follow her to the new space, and let her control the system. In some systems, she is provided with the option of applying her previous scenes, as well as creating or adjusting scenes tailored for the new space.

Additionally, there may be administrators or other persons who have the ability to "commission" hardware and grant access to users. One example of such a privilege granter is a hotel receptionist. In one embodiment, a hotel receptionist gives a guest the ability to control the lighting in a hotel room. The privileged user can send information about the new user to the server. The server can acknowledge receipt of the information and present an authorization code to the privileged user. The privileged user can give the new user the code, which can be sent to the server with every command controlling the system.

In various embodiments, once a user is granted permission for a system, she can have automatic recognition and need only enter the space containing the system in order to control it. Once the wireless connection between the smart phone and the server is achieved, the device can be recognized. The user can have control immediately, her preset controls can be engaged and she then has permission to make any commands to further control the system.

In some embodiments, once the user's smart phone is recognized, the system can automatically adjust the lighting to the user's preferences. The user can also have the ability to adjust lighting through controls on their personal control device, such as a smartphone.

Additionally, a single user may become authorized for several different systems in several different spaces.

Systems

Various embodiments of the present invention are directed to systems that comprise: (1) an executable computer program product that when executed can automatically carry out the steps of the methods of the present invention; (2) a controller that comprises a central processing unit, wherein the central processing unit is capable of (i) carrying out the steps of one or more of the methods described herein, (ii) receiving input of a profile for each of a set of lighting devices, and (iii) transmitting instructions to one or more illumination devices; and (3) a set of illumination devices, wherein each illumination device is configured to receive said instructions, and when said instructions are executed by the set of illumination devices, to create the mood lighting scene in the environment.

Each illumination device, which also may be referred to as a lighting fixture, may be capable of wired or wireless or a combination of wired and wireless communication with the central processing unit. Communication may, for example, be through one or more of WiFi, Bluetooth, and infrared technology. Each light fixture may be connected to an external or internal power source that can supply power for both lighting and communications purposes.

The controller may be configured to generate instructions that affect lighting parameters of the illumination devices. These parameters include but are not limited to, on/off status, RGB color value, dynamic white light heat and dimmability. By way of a non-limiting example, the controller may have an 802.11 WiFi chip, ZigBee (z-wave) and/or Bluetooth chip and/or an NFC or other wireless communications radio.

WiFi enabled lights can include lights that have a WiFi chip that is integrated into a control circuit. This includes, but is not be limited to, WiFi bulbs, WiFi adapters, WiFi switches, in-fixture integrated WiFi chips, inside control boxes and bridged technologies. Communications may also be through a phone network that includes a user's smartphone connection that is not only via WiFi, but also a phone data network or a cellular telephone network using communication protocols such as 3G, 4G, LTE or other data connectivity protocols. For these types of communications, the server may be configured in such a way that enables a direct communication protocol to interface with the smartphone device.

The system may also comprise a user input device or the controller may be configured to service both the user input device and the executor of instructions that control mood lighting scenes. The user input device may, for example, be a smartphone with a graphic user interface that has a touchscreen. In some embodiments, the user interface is capable of being tracked through GPS technologies.

In various embodiments, the wireless control device, such as a personal smartphone, can connect directly to each light, or in alternative embodiments, a communications bridge, gateway or router can act as an intermediary between the wireless control device and the lights. These devices may translate a smartphone's native wireless signal (with its embedded WiFi chip, for example) into other wireless communication protocols, such as WiFi-Zigbee 802.15, Bluetooth, or Z-Wave, that can then talk directly through WiFi to appropriately configured lighting hardware. It can also act as a server and store settings.

The system can also contain a server and database, either at the location of the lighting system, or remotely connected through a network, such as the Internet, and may have storage on the control device itself and/or at a remote site. A wireless control device can have a standalone application or program and/or a web application that can allow users to control the lighting system. A server can be based locally or also be cloud based and can be installed on any local computer; thus, it doesn't need to be an extra piece of hardware. Additionally, it can be software that can run on any appropriately configured machine.

In some embodiments, a control device, such as a smartphone, also may connect to a server at the site of the lighting system, or to a server in the cloud. The system may have the wireless control device associating with a particular space's lighting and connecting to any one or more of a site-specific server, a cloud-based server or other hardware, such as the control device itself. Connections to the cloud-based server may be through the wireless system, or the wireless control device's alternate communications system. The smartphone may be configured to connect to several devices in addition to lights. In some embodiments, a connection to other types of systems, including audio equipment, HVAC, window shades, cameras, sensors, and other electronic devices can also be accommodated.

The computer program product, which also may be referred to as a control program may be stored in an electronic storage connected to the server or cloud or can be pre-loaded onto the device itself. The electronic storage can retain information about the lights in the system, the light configuration, the light scene composition and the users and their behavior preferences and patterns. The control program can allow a user to manipulate the lighting system in a number of ways disclosed herein. In addition to lighting, embodiments can contain control of other electrical appliances and devices, including but not limited to, audio equipment, HVAC equipment, thermostats, music systems, and window shades.

Brightness Measurements Between Types of Lights

Illumination in an environment is the overall effect of the output of fixtures in a given space. It refers to how the light is bundled and directed. Below is a general framework of how the brightness is affected by using a glowing light vs. an indirect light vs. a directed light:

If Fixture Type (FT) is glowing (g), then the light output is brighter than indirect lighting by multiples, and the light output should be reduced compared to an indirect fixture to balance the base default setting. Glow has more light output than direct or indirect; hence it needs to be less or more to equate to similar brightness levels of direct or indirect ambient light: Glow>indirect=FTg=−(5-20%).

If Fixture Type (FT) is indirect (i)/reflected light, then the light output is less than a glowing fixture, and light output should be increased to balance the base default setting. An indirect light needs to be brighter since it is more diffuse and travels further than glow: Indirect>glow=FTi=+(5-20%).

If Fixture Type (FT) is directed (d) light, then light output is concentrated and max towards one direction, but not others, and it is more localized and provides less ambiance and overall illumination, so its overall brightness is less than a glow, but more than an indirect lighting: Glow>Direct>indirect: FTg>FTd>FTi.

Mood Algorithm

In some embodiments, a mood algorithm can define a specific process about how a lighting scene is generated. It can take several parameters, including one or more of fixture type, illumination type, room type, quantity of light sources, location and mounting type, and then describe as a result the behavior of the light setting. There may be a different algorithm for each mood type or they may all be part of the same algorithm.

By way of a non-limiting example, a base line energize mood may be calculated according to the following parameters and an algorithm may be used that includes one, a plurality, or all of these parameters, and although the types of light fixture are recited below, within the algorithm, they may be referred to as first light type, second light type, third light type, fourth light type, etc. for a first mood, second mood, third mood, fourth mood etc.

For a first a first mood (energize) one may adhere to the following rules and optionally use an algorithm that includes some or all of them:

- DL (down light): max or high brightness value (typically 90-100%) with a colder white tone
  - if DL=on/off, then ON
  - if DL=dim, then 80-100%
  - if DL=color changing such as RGB, then blueish white
  - if DL=dynamic white, then it should be between 4000-5000K
- PL (pendant light)=creates overall brightness and task illumination. PL may be defined as follows:
  - if PL=on/off, then ON
  - if PL=dim, then 50-90%
  - if PL=color changing such as RGB, then neutral white
  - if PL=dynamic white, then it should be between 3000-4000K
    - glow=yes, brings ambiance and highlight of area; should be bright PLg=~60-80%
    - direct=yes, brings light where it's needed and highlights an area e.g., table; PLd=~80-100%
    - indirect=doesn't play a big role, since it creates some ambiance: PLi=~50-70%
- WS (wall sconce): max or high brightness. WS may be defined as follows:
  - if WS=on/off, then ON
  - if WS=dim, then 30-60%
  - if WS=color changing such as RGB, then neutral to warm white
  - if WS=dynamic white, then it should be between 3000-3500K
    - glow=yes, creates brightness: PLg=~60-80%
    - direct=yes, creates brightness: PLd=~80-100%
    - indirect=will not have much impact and therefore can be either on or off: PLi=~50-70%
    - indirect up/down=will have more light and is therefore similar to indirect
  - =glow>direct>up/down>indirect
- SL (step light): are low level lights (typically towards the bottom of the space/below 4') that are integrated into a vertical surface. SL may be defined as if SL=on/off, ON and in some locations OFF esp. when other lights are in the space
if SL=dim, then 20-60%
if SL=color changing such as RGB, then neutral to warm white or a color
if SL=dynamic white, then it should be between 3000-4500K UL (up light): is a light shining upwards. UL may be defined as:
if UL=on/off, then ON and in some locations OFF esp. when other lights are in the space
if UL=dim, then 70-100%
if UL=color changing such as RGB, then neutral to warm white or a color
if UL=dynamic white, then it should be between 3000-4500K
Relationship with other lights:
a direct UL will create brightness, but when DL, PL, FL or other ambient glow objects are in the space it will not make as much of a difference. this means it needs greater brightness in relationship to a DL or PL or if it is a ULd it will create a targeted highlight
a ULglow=will help to generate general brightness FL (floor lamp): typically sitting on a horizontal surface below table level. FL may be defined as:
if FL=on/off, then ON
if FL=dim, then 70-100%
if FL=color changing such as RGB, then neutral to warm white or a color
if FL=dynamic white, then it should be between 3000-4500K TL (table light or task light): typically located on eyelevel or on a table. TL may be defined as:
if TL=on/off, ON
if TL=dim, then 80-100%
if TL=color changing such as RGB, then neutral to warm white or a color
if TL=dynamic white, then it should be between 3000-4500K ST (strip light): strip lights depends on where it is located in a space and how visible its light output is, e.g. a toe kick indirect lighting=off while a cove located in the ceiling should be high or on. ST may be defined as:
if ST=on/off>ON and in some locations OFF
if ST=dim>then 80-100%
if ST=color changing such as RGB>then neutral to warm white or a color
if ST=dynamic white>then it should be between 3000-4500K
Relationship with other lights:
a direct UL will create brightness, but when DL, PL, FL or other ambient glow objects are in the space it will not have a significant impact
typically has little contrast since it should create a more even lit space with general brightness
if ST is indirect=yes, but if down lights are at play it could be overpowered and it only gives little light and therefore should be turned off if FT (unknown): default should be
if unknown=on/off, then ON
if unknown=dim, then 80-100%
if unknown=color changing such as RGB, then neutral white
if unknown=dynamic white, then it should be between 3000-4000K For a second mood (romance or late night or TV):

These moods call for is a dimly lit environment with primarily indirect lighting when available. Localized lighting is emphasized to create a cozier atmosphere. White and color hues are warm to amber to generate a candle or fireplace-lit feel and create a sense of mystery.

As general rules, these moods may call for an overall dimness as combined from all fixture of approximately 5-20% of the maximum brightness level. Thus, any light fixture by each manufacturer may be checked as to what their minimum possible dimming value is and then be adjusted to that as a reference e.g., some manufacturers only provide 10% instead of 5%. The rules and formulas may be then adjusted accordingly with individual manufacturer factors. These moods have their most emphasize on localized lighting (FL, TL, PL). Their direct portions, if available may have the highest lighting output by default (TLd, Fld, Pld>as other lighting) and be warm white/amber color. They may also emphasize also low level lights (ST, SL, UL, FL). Further, there may be emphasis on indirect lighting, if it is directed downward (e.g. STi, FLi, TLi, PLi). Additionally, one may avoid large glowing lighting objects (PL, FL, WS) or dim them as localized lighting.

Thus, indirect lighting is preferred over >direct>glow and may be managed accordingly in lighting output. In some embodiments, downlights are off at all times, unless no other light is in the space; there is little contrast; even illumination; color temperatures are coordinated between pairs of lighting such as TL=FL; the color scheme is either very amber golden or deep mysterious blue as default color choices; glow is less while indirect, downward directed lighting is preferred and needs higher lumen output; and direct as localized lighting may be used if it is placed in the areas of activities such as a couch or table.

For these moods one may adhere to the following rules and optionally use an algorithm that includes some or all of them:

DL: Off or minimal value if no other light source is in the space (typically 5-20%) with amber warm white tones. DL may be defined as
if DL=on/off>OFF
If DL=dim>then 5-20%
if DL=color changing such as RGB>amber color or deep bluish purple
if DL=dynamic white>then it should be between 2000-2500K (amber, golden, warm white)
Relationship with other lights:
if no other lights are in the space, then downlight should be ON or dim PL: is high level lighting. PL may be defined as
if PL=on/off>OFF; unless there is no other fixture in the space
If PL=dim>then 10-30%
if PL=color changing such as RGB>then warm white, golden amber
if PL=dynamic white>then it should be between 2300-2700K
glow=no, brings emphasize to ceiling; one may use a little to give the room some definition, PLg=~5-15% as minimal as possible or off
direct=yes, as it brings localized task lighting such as a table; PLd=~20-50%
indirect=doesn't play a big role, since it brings lighting on the ceiling; if it is up it should be off or little so deemphasize ceiling illumination: PLi=~5-30%

WS: brings attention to the room periphery which one may want to avoid. WS may be defined as if WS=on/off>OFF, unless no other light is in the space
If WS=dim>then 50-30%
if WS=color changing such as RGB>then warm white, golden amber or bluish purple
if WS=dynamic white>then it should be between 2300-2700K
glow=very little as one may want to bring lighting into the periphery, PLg=~5-20%
direct=some, little; PLd=~5-30%
indirect=yes, to create a sense of space: PLi=~10-40%
indirect up/down=will have more light and is therefore similar to indirect
=up/down>indirect>direct>glow SL: are low level lights (typically towards the bottom of the space/below 4') that are integrated into a vertical surface. SL may be defined as
if SL=on/off>ON
If SL=dim>then 30-80%
if SL=color changing such as RGB>then warm white, golden amber or bluish purple
if SL=dynamic white>then it should be between 2300-2700K
glow=provides warmth, PLg=~5-20%
direct=distracts from the localized lighting and puts emphasize on other areas and periphery, PLd=~5-30%
indirect=yes, PLi=~10-40%
=Indirect>glow>direct UL: is an uplight shining upwards. UL may be defined as
if UL=on/off>ON
If UL=dim>then 10-40%
if UL=color changing such as RGB>then warm white, golden amber or bluish purple
if UL=dynamic white>then it should be between 2300-2700K
Relationship with other lights:
a UL will create brightness, but when localized or indirect lighting is in the space such as FL, TL, ST, SL are in the space it could potentially overpower them and therefore they always should be less prominent as them (same or less light output)

FL: is a floor lamp typically sitting on a horizontal surface below table level. Floorlamps bring localized and task lighting and should be fairly prominent and some of the brightest in the room. FL may be defined as
if FL=on/off>ON
If FL=dim>then 15-50%
if FL=color changing such as RGB>then warm white, golden amber
if FL=dynamic white>then it should be between 2300-2700K TL: is a table light or task light typically located on eyelevel or on a table. TL may be defined as
if TL=on/off>ON
If TL=dim>then 15-50%
if TL=color changing such as RGB>then neutral to warm white or a color
if TL=dynamic white>then it should be between 2300-2700K
Relationship with other lights:
TL and FL may be balanced; have the same color temperature if possible and both me the most prominent lighting elements ST: is a linear light source. Strip lights depends on where it is located in a space and how visible its light output is, e.g. a toe kick indirect lighting=off while a cove located in the ceiling may be high or on. ST may be defined as
if ST=on/off>ON and in some locations OFF
If ST=dim>then 15-50%
if ST=color changing such as RGB>then warm white, golden amber or bluish purple
if ST=dynamic white>then it should be between 2300-2700K
glow=very little, one doesn't want to bring lighting into the periphery, STg=~5-20%, but no more lighting output than WS, PL
direct=little; STd=~5-30%
indirect=yes, to create a sense of space: STi=~10-40%, light output should balance with UL, WS, PL
indirect up/down=will have more light and is therefore similar to indirect
=glow>direct>up/down>indirect
Relationship with other lights:
depending on the illumination type and location ST should be coordinated in light output with PL, WS, FL, UL and ensure they are balanced.
if they are located in the wall or ceiling they should have less light output compared to localized lighting such as FL or TL's or PL's if FT: fixture type unknown. FT may be defined as
if unknown=on/off>OFF unless there is no other light in the space
if unknown=dim>then 5-20%
if unknown=color changing such as RGB>then amber golden or a deep purple bluish
if unknown=dynamic white>then it should be between 2300-3000K For a third mood (lounge also known as relax) one may balance indirect and direct illumination with a hint of warmer white and amber tones. Thus, one may follow the following general rules: overall dim: ~30-60% brightness level, general soft ambiance, some contrast, glowing light fixtures are preferred such as FL, TL, PL, WS, more soft indirect and ambient lighting, warm white to amber (sunset), color temperatures shall be coordinated between pairs of lighting such as TL=FL, color scheme is around a warm color hue palette e.g., amber with soft reds and warm whites.

Hotel Applications

The various embodiments may, for example, be advantageous to use in connection with hotel rooms. A hotel may set up one or a plurality of mood lighting scenes for each room. Because typically, the types of lighting fixtures are the same for each room, the pre-programmed instructions for each room would at least initially be the same.

A user may enter a hotel and check in at the front desk. A privileged user, e.g., receptionist, sends information to the server about the new user or a direct input from the reservation and check-in system sends the information. The server can send a code to the new user, who enters it into her smartphone or directly to the new user's smartphone or access device. She now has access to the system for a particular room. The access code can be sent to the server with every command, and may be set to expire after a time period. If the user is only staying for three nights, for example, the code can be set to expire upon check out time, and no longer afford the user access.

Optionally, through the application the user may be able to adjust any of the controllable variables. For example the user may send an instruction to increase the brightness from a fixture by 10-25% or to decrease the brightness from a fixture by 10-25%. If the system is configured to permit adjustment of a parameter, it may also be configured to provide the user with the option of saving the adjusted configuration. Thus, for a particular user (customer) a mood may be a variant of the pre-configured mood and that customer specific mood could be stored such that when the user revisits the hotel, regardless of the room that the customer uses or the city which the room may be located, the adjusted mood or moods are implemented when selected. Furthermore, different users, e.g., different members of a family, organization, team, group or office may be able to save their preferences for the same environment.

For convenience, a hotel may use a customer's loyalty number as a user ID and/or to track mood settings.

Various embodiments of the present invention may be further appreciated by reference to the accompanying figures.

FIG. 1 is a representation of a process of fixture configuration. A user enters a commissioning sequence 110. The user or the system locates the lighting devices in the room 120. This can be done through a visual inspection of the lighting devices in the room and then through an appropriate computer interface or a pre-upload of fixture properties assignment into the database, selecting a fixture type for each fixture or potentially even done through an identifier on each fixture itself or other means such as taking a photo 130. Next one selects the illumination type or types for the fixture 140. As a check, the system may consult an internal or remote database in order to confirm that the properties that the user selected are consistent with those known for the selected type of lighting device 150.

The system may then query the user as to whether all lighting devices have been commissioned 160. If the answer is no, then the user reenters the commissioning sequence 110. If the answer is yes, then the system will execute a module that extracts base settings or modified settings in order to generate a lighting scene 170. Once the instructions are obtained or created, the system activates pre-configured light scenes 180.

Figure 2:
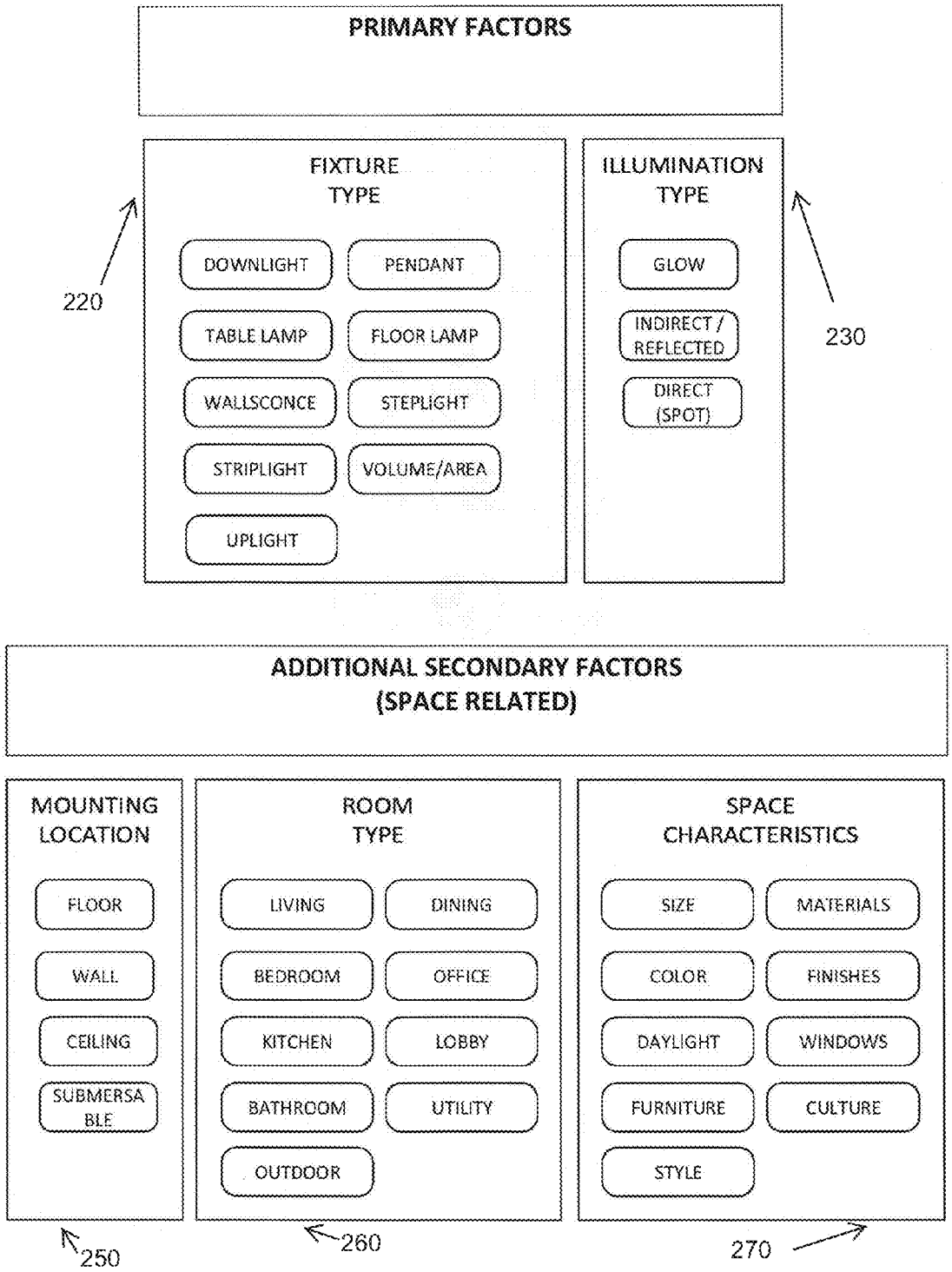
FIG. 2 is a representation of examples primary factors (also referred to as static properties) and secondary factors (space related) for a light scene composition.

FIG. 2 is a representation of configuration factors and variables for a light scene composition. Examples of primary factors that may be used are identified include the fixture type 220 (e.g., down light, table lamp, wall sconce, strip light, up light, pendant, floor lamp, step light and volume/area light), and illumination type (e.g., glow, indirect/direct, and direct/spot). Also shown are secondary factors, which might include mounting location (e.g., floor, wall, ceiling, and submersible area) 250, room type (e.g., living room, bedroom, kitchen, bathroom, outdoor, dining room, office, lobby and utility) 260, and space characteristics (e.g., size, color, daylight, furniture, style, materials, finishes, windows, and culture) 270.

Figure 3:
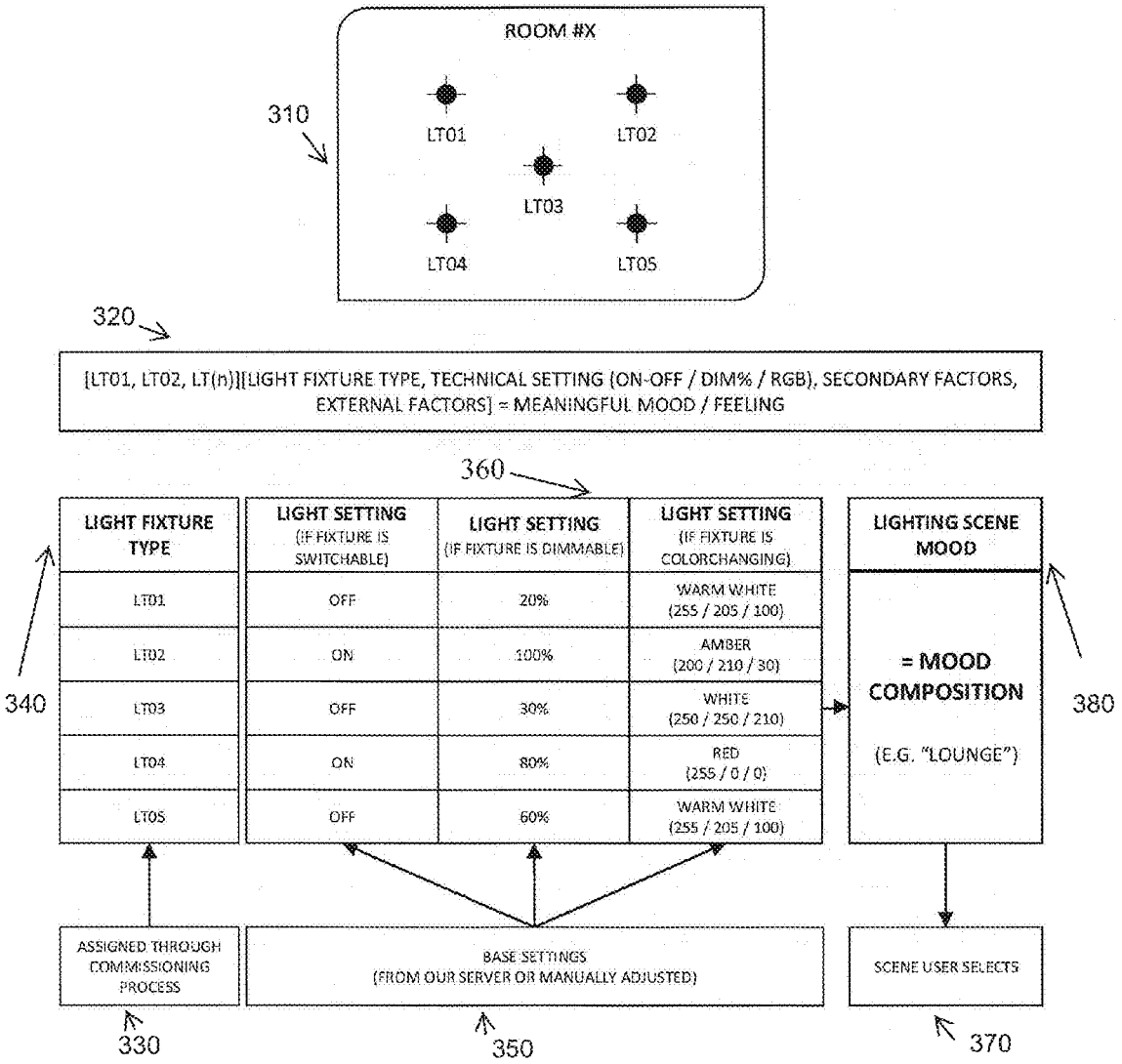
FIG. 3 is a representation of an example of a light scene setting.

FIG. 3 is a representation of an example of light scene settings. At the top of the figure is a representation of room #X 310, which shows fixtures LT01, LT02, LT03, LT04, and LT05 placed in the room. As shown in the box below 310, there are static parameters and controllable parameters for each fixture 320. For each fixture there is a commissioning process 330 that associates a light fixture type 340 with each fixture. Base settings may be associated with each fixture due to either retrieval of information from a server or manual adjustment or a combination thereof 350. For a switchable light, an on/off setting is assigned to each fixture, as is a brightness level expressed as a percentage of maximum brightness and an RGB color changing feature if applicable 360 to generate one or more sets of instructions for lighting scenes. The example that is shown is characterized as a mood composition that is equivalent to a lounge 380. From the set of mood lighting scenes within the database, the user selects a scene 370.

Figure 4:
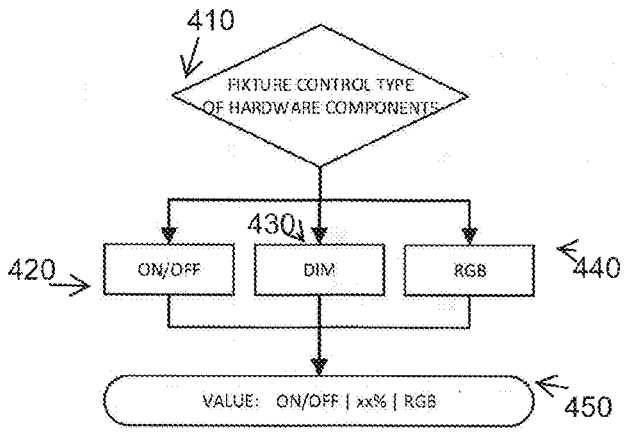
FIG. 4 is a representation of an example of pre-configured lighting scene base settings for a bedroom.

FIG. 4 is a representation of pre-configured lighting scene base setting for a bedroom environment. There is a set of fixtures control types or hardware components 410. They comprise on/off status 420, dimming status 430 and RGB status or any other color changing chipset components 440, which define the parameters values of ON/OFF, XX % and RGB 450. For each of the four scenes there is a configuration for each type of fixture as shown in the table 460.

Figure 5:
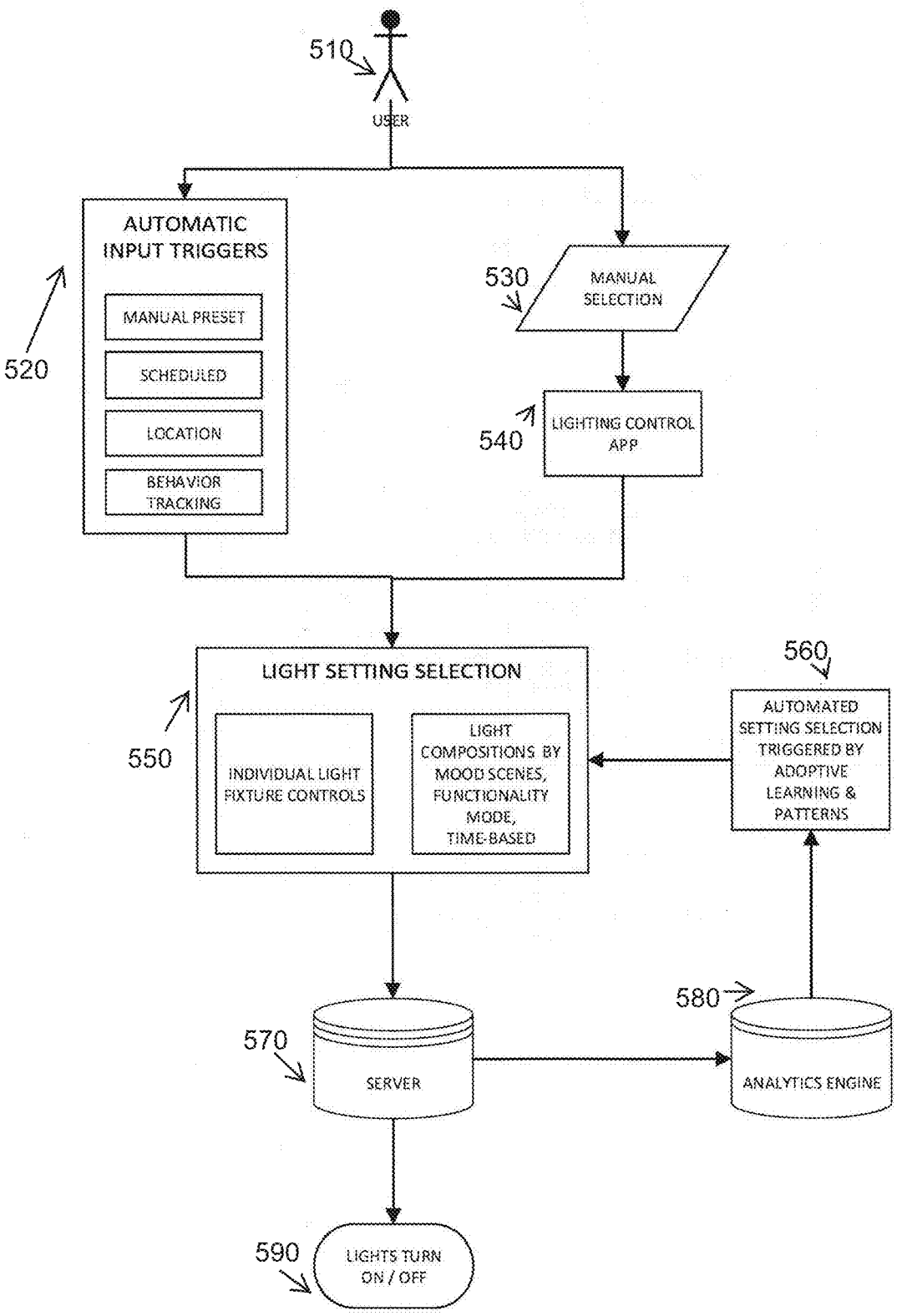
FIG. 5 is a representation of an example of a light scene selection process.

FIG. 5 is a representation of a light scene selection process. A user 510 initiates an automatic input trigger 520 that looks for information pertaining to one or more of manual present scenes, scheduled scene, location of the user and behavior tracking. Alternatively or additionally, the user begins a manual selection of a scene 530 and enters a lighting control app 540.

Next, the light setting selection is begun 550, which focuses on individual light fixture controls and light compositions by mood scenes, functionality mode and time-based parameters. This data is sent to a server, cloud or local control component wherever it makes sense to incorporate the database in a particular setup 570, which controls when the lights are on or off 590. The server may also initiate an analytics engine 580, which causes there to be an automated setting selection trigged by adaptive learning and patterns 560.

Figure 6:
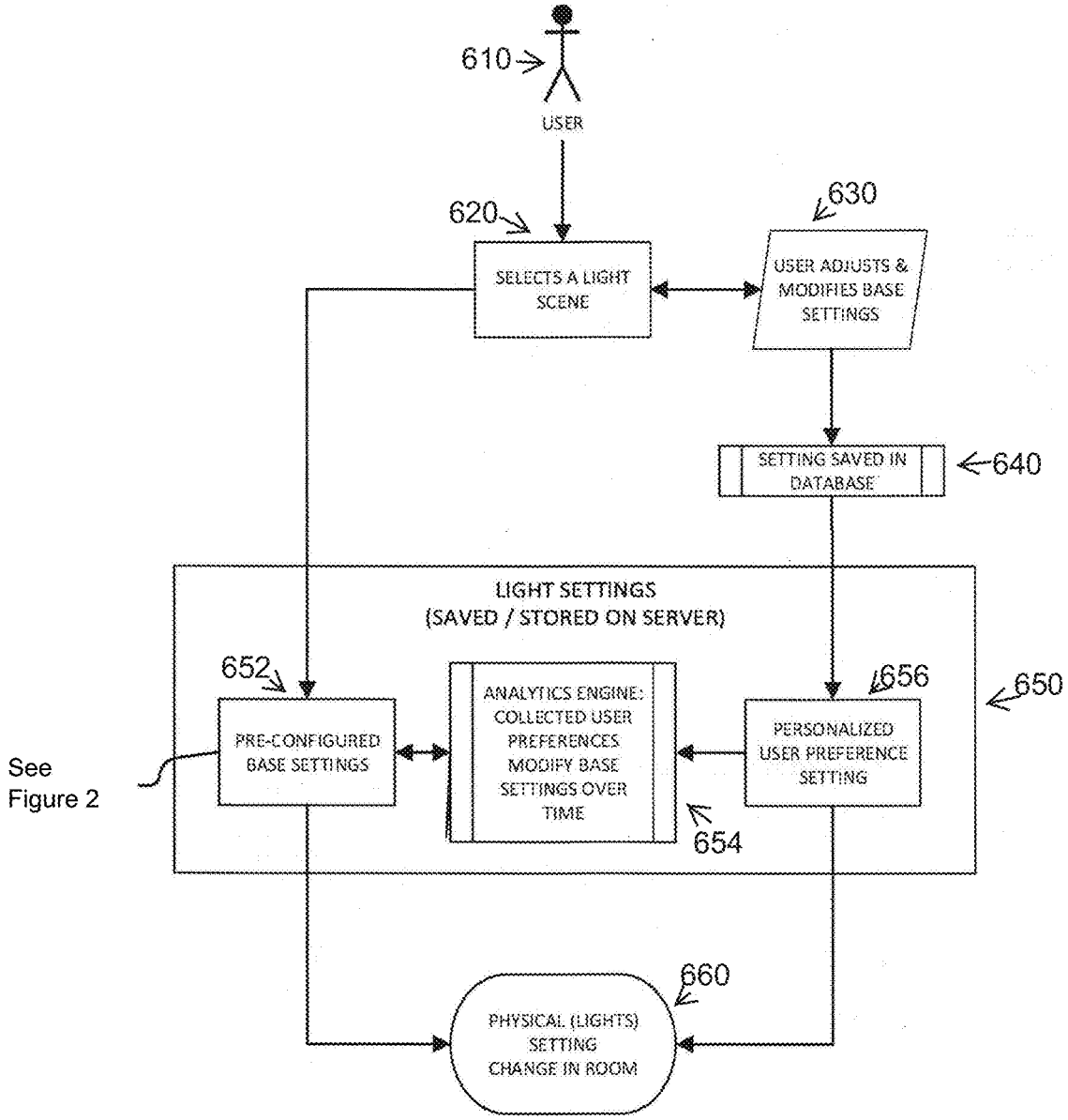
FIG. 6 is a representation of an example of a light scene selection process with a personalized configuration process.

FIG. 6 is a representation of a light scene selection with a personalized configuration process. A user 610 selects a light scene 620. The user may adjust and modify base settings 630 and either select another scene or save the settings in database 640. The light settings are stored on a server 650. The server may, for example, be configured to compile user identification data, WiFi or GPS location information and fixture and smartphone identifiers and addresses.

After the user has selected a scene and while adjusting or modifying base settings, the system accesses the pre-configured base settings 652, and activates the analytics engine, which corresponds to collected user preferences for modifying the base settings over time 654. The analytics engine also receives personalized user preference settings 656. From either the pre-configured base-settings or the personalized preference settings, the system causes a change in the light setting of a room 660.

Figure 7:
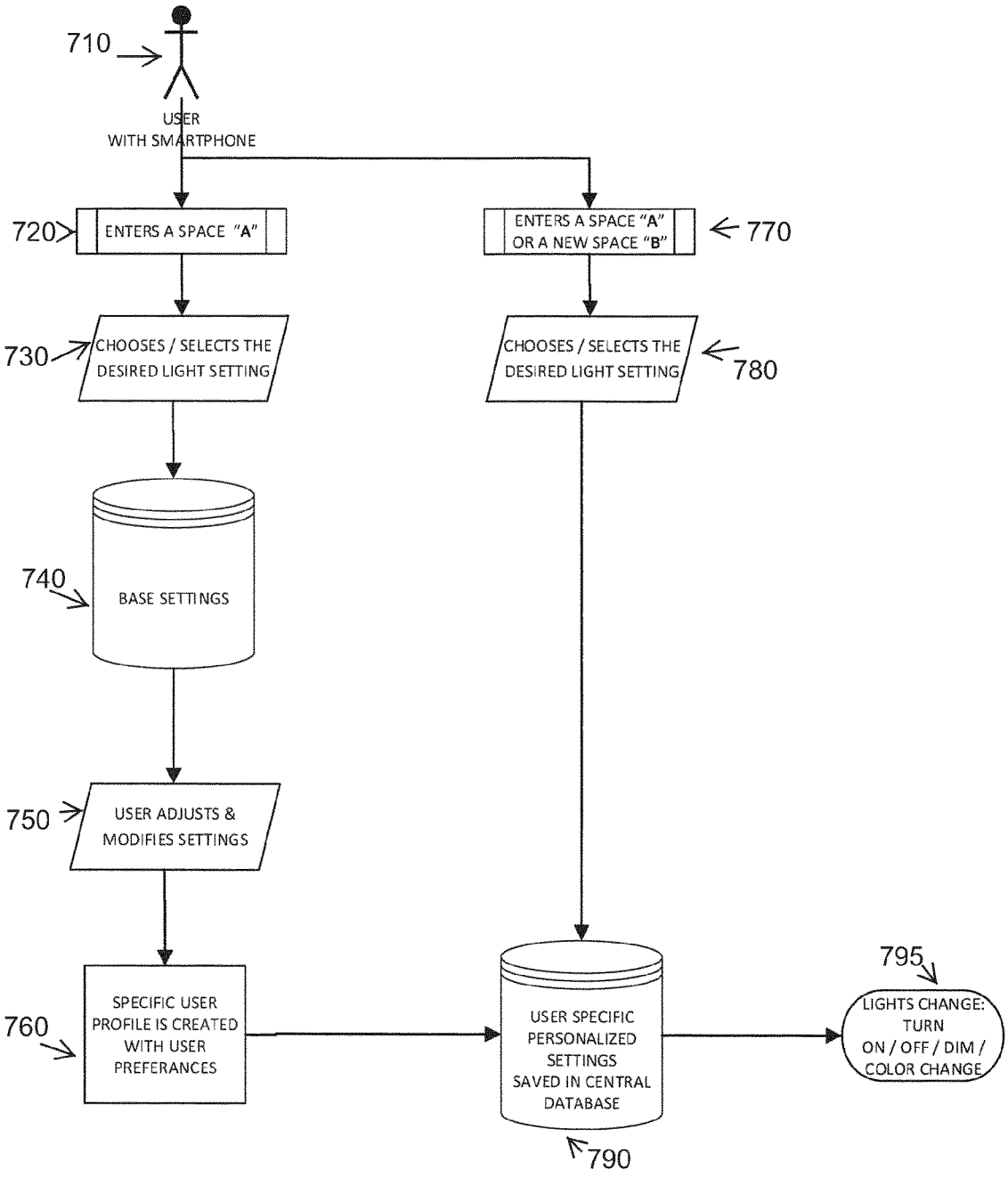
FIG. 7 is a representation of an example of remote access of personalized user preferences throughout one or more locations.

FIG. 7 is a representation of remote access of personalized user preferences throughout one or more locations. A user with a smartphone 710 enters a space 720. The user chooses or selects the desired light setting 730. The system accesses base settings 740. The user adjusts and modifies the settings 750 and a specific user profile is created with the user preference 760. These user specific personalized settings may be saved in a central database 790. Then the lighting with an environment may change 795. In an alternative method there is no need to access base settings or make user adjustments. Thus, after the user with the smartphone enters a space A or new space B 770, the user chooses or selects the desired light setting 780 and user specific personalized settings may be saved in a central database 790. Then the lighting with an environment may change 795.

Figure 8:
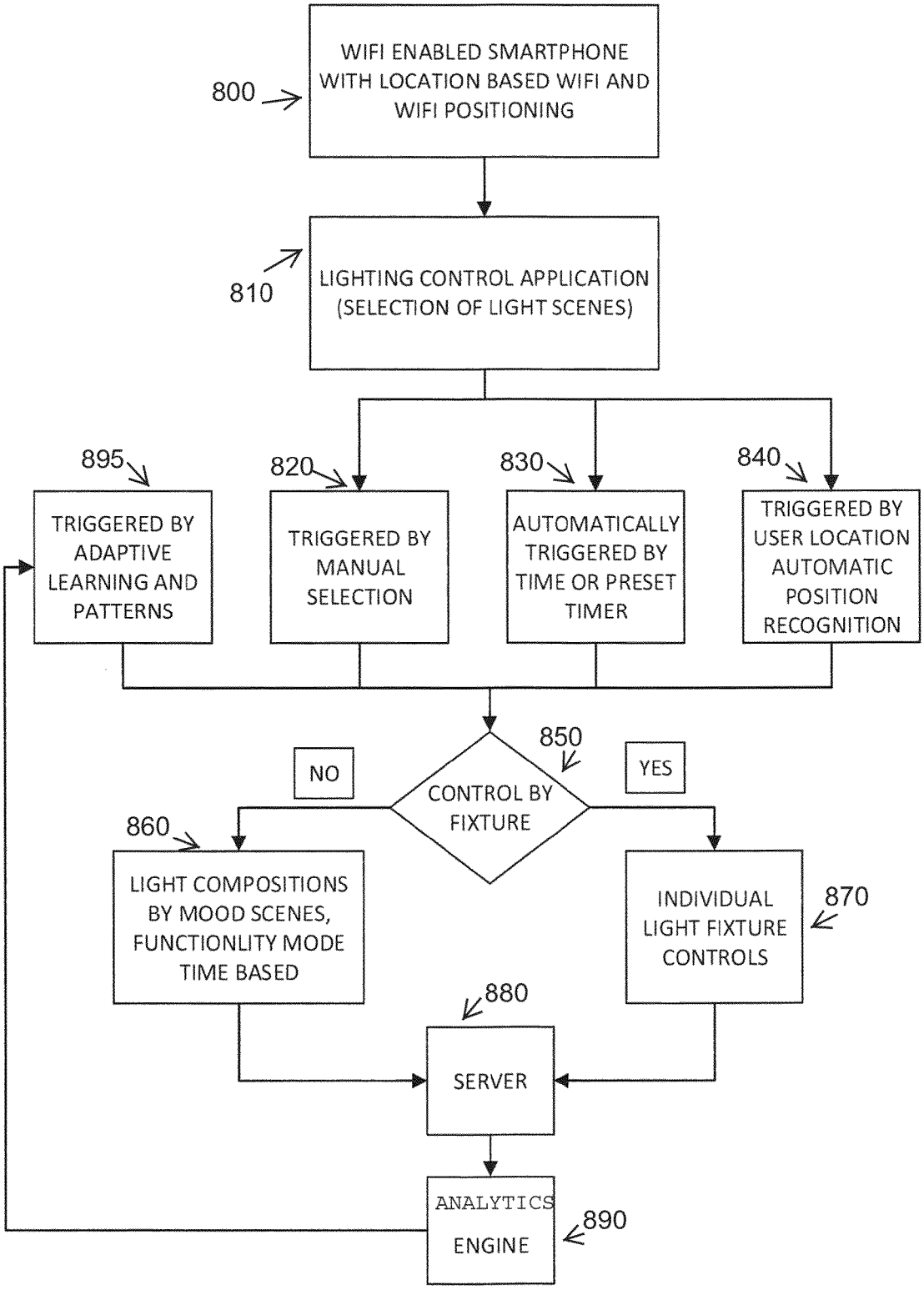
FIG. 8 is a representation of an example of a set of factors that influence and trigger a light scene setting.

FIG. 8 is a representation of a set of factors that influence and trigger a light scene setting. A WiFi enabled smartphone or other computing device such as a smartwatch (e.g., i-watch) or tablet or communication enabled jewelry with location based WiFi and WiFi or GPS positioning is used 800. A lighting control application is initiated to select light scenes 810. The light scenes may be trigged by manual selection 820, by time or a preset timer 830 or by user location, which is determined through, for example, GPS technology 840.

Next there is a query as to whether to exert control of a fixture 850. If the answer is yes then there is individual light fixture control 870. This information is transmitted to the server 880. If the answer is no then the light compositions are defined by a mood scene 860. This information is transmitted to the server 880.

The server transmits the information to an analytics engine 890, which triggers adaptive learning patterns 895 that can be feedback to allow for more control by the fixture.

FIG. 9A is a representation of a prior art method for setting a lighting scene. A user identifies a light fixture 900. The user assigns settings to each individual light fixture existing in the room 910 and then asks whether she has identified lights in the room 920. If the answer is no, then steps 900, 910, and 920 are repeated. If the answer is yes, then the user groups fixture together 930 and assigns attributes to the fixtures 940. Finally, she saves the settings and labels them as a scene 950.

FIG. 9B is a representation of a method of an embodiment of the applicant's invention. Under this methodology, a user identifies a light fixture 960. The user assigns settings to a light fixture 970 and then asks whether she has identified lights in the room 980. If the answer is no, then steps 960, 970, and 980 are repeated. If the answer is yes, then an automated module groups lights and assigns attributes 990. Finally, she selects a preconfigured scene from a list 995.

Figure 10:
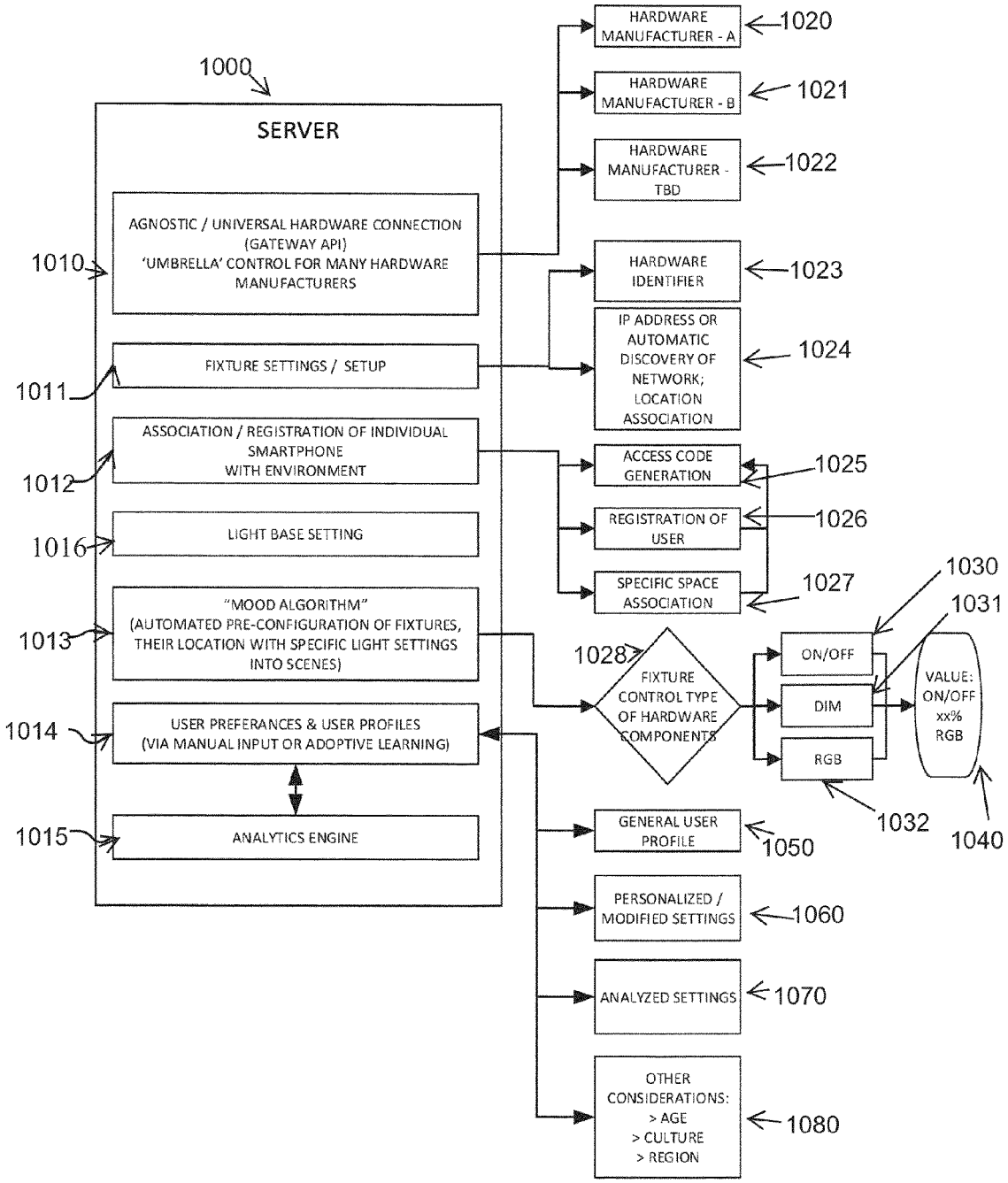
FIG. 10 is a representation of an example of an embodiment of the present invention that shows a server and various components.

FIG. 10 is a representation of a server 1000 or database or other computing device that may be used in connection with the present invention. The server's components include an agnostic/universal hardware connection (gateway API) that allows for umbrella control for hardware from many manufacturers and with many different wireless protocol 1010, e.g., hardware manufacturer A, which could in one embodiment have a wireless ZigBee communication protocol 1020, hardware manufacture B, which could have in one embodiment have a Bluetooth communication protocol 1021 and additional hardware manufacturers to be determined 1022. The server contains a fixture setting/set up module 1011 that may have a hardware identifier 1023, and an IP address or automatic discovery of network location association 1024.

The server may also contain an association or registration of an individual smartphone with the environment module 1012. This module is capable of generating an access code 1025, registration of a user 1026, and association with a specific space 1027.

The server may also contain light base settings 1016. This may be in the form of a database.

The server may also contain a mood algorithm. The mood algorithm is for automated pre-configuration of fixtures or their location with specific light settings as configured in scenes 1013. This mood algorithm considers the fixture control type and hardware components 1028, and then as applicable for each fixture considers on/off capabilities 1030, dimness or brightness level 1031, and RGB values 1032, and generates values 1040.

The server may also contain a database of user preferences and/or profiles that it has acquired through manual input or adaptive learning 1014. This information may include or more or all of a general user profile 1050, personalized/modified settings 1060, analyzed settings 1070 and other information such as age, culture, region and religion 1080.

Figure 11:
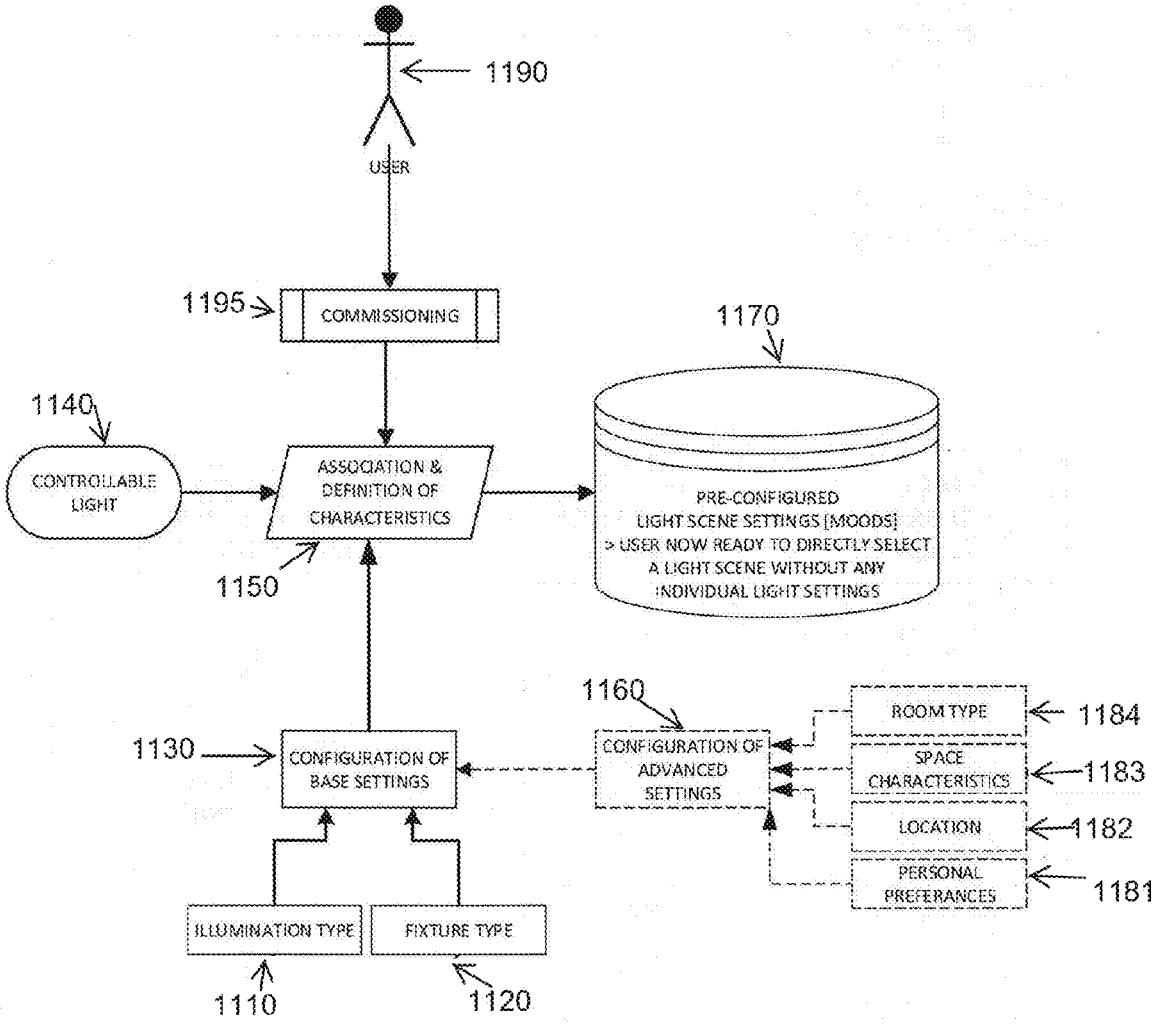
FIG. 11 is a representation of an example of a commissioning process.

FIG. 11 is a representation of a commissioning process for a new light fixture. A user 1190 initiates the commissioning process 1195. A database contains a configuration of base settings 1130, which may be delineated by illumination type 1110 and fixture type 1120. Optionally, the base settings also consider advanced settings 1160, which may draw upon room type 1184, space characteristics 1183, location 1182 and personal preferences 1181. With the information, for a controllable light 1140, the process associates and defines characteristics of the fixture 1150. It transfers this information to set of pre-configured light scene settings (moods) and the user is now able to directly select a light scene without any individual light settings 1170.

Figure 12:
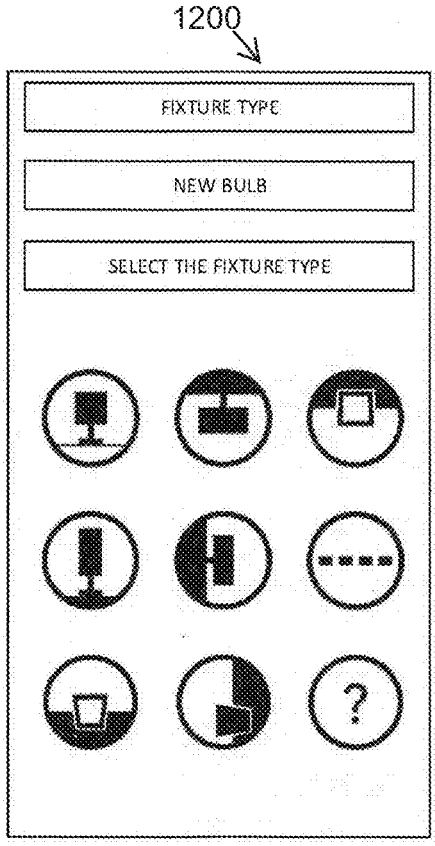
FIG. 12 is a representation of an example of a configuration screen that shows a plurality of different fixture types.

FIG. 12 is a representation of a screen shot 1200 that allows for a user to select a fixture type by icon that correlates with the fixture type such as Table Light, Pendant, Down light, Floor light, etc.

Figure 13:
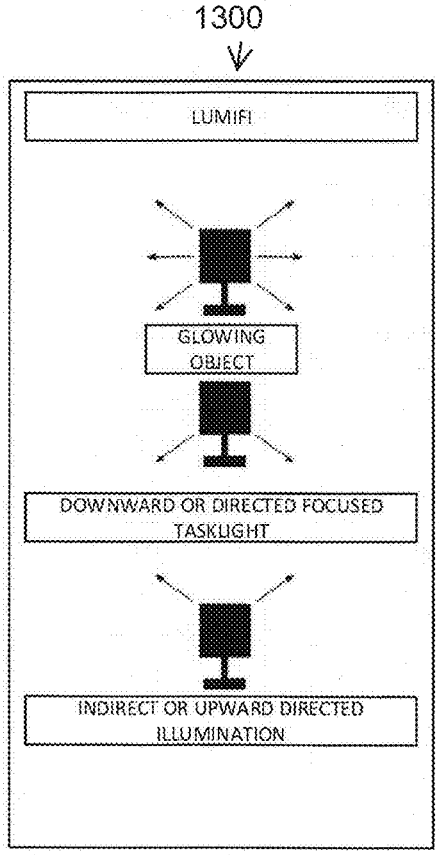
FIG. 13 is a representation of an example of another configuration screen.

FIG. 13 is a representation of a screen shot 1300 that allows for a user to select a static feature of a fixture based on the direction that the fixture emits light.

Figure 14:
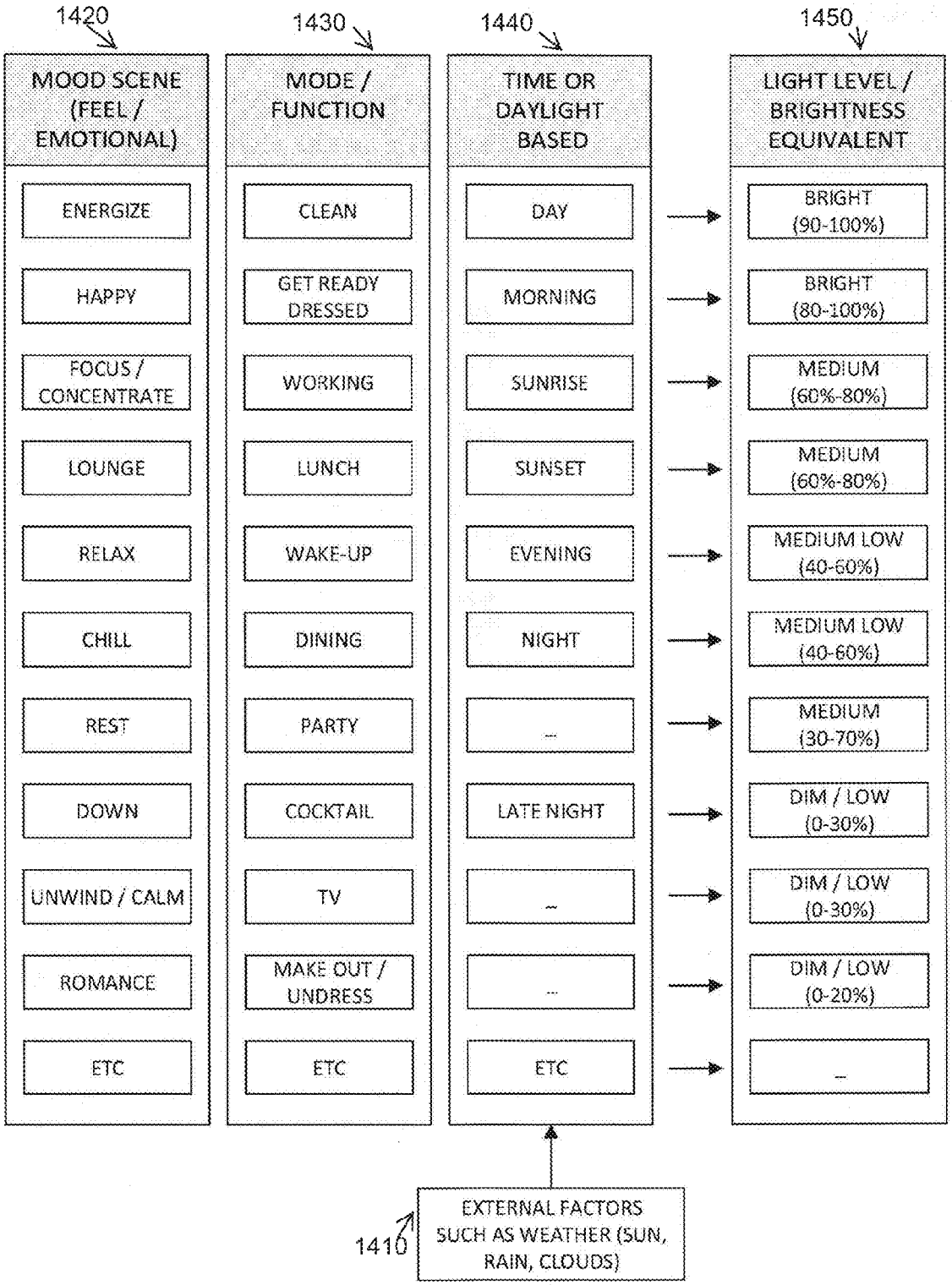
FIG. 14 is a representation of an example of primary light scene types and categories.

FIG. 14 is a representation of primary light scenes and category types that in some embodiments may be used to determine base target light levels. In generating these light scenes, one may begin with a mood scene 1420, consider a mode or function of the mood 1430 and the time of day 1440, which may take into account external factors such as weather 1410. With this information the system may determine a brightness level that is appropriate 1450.

Figure 15:
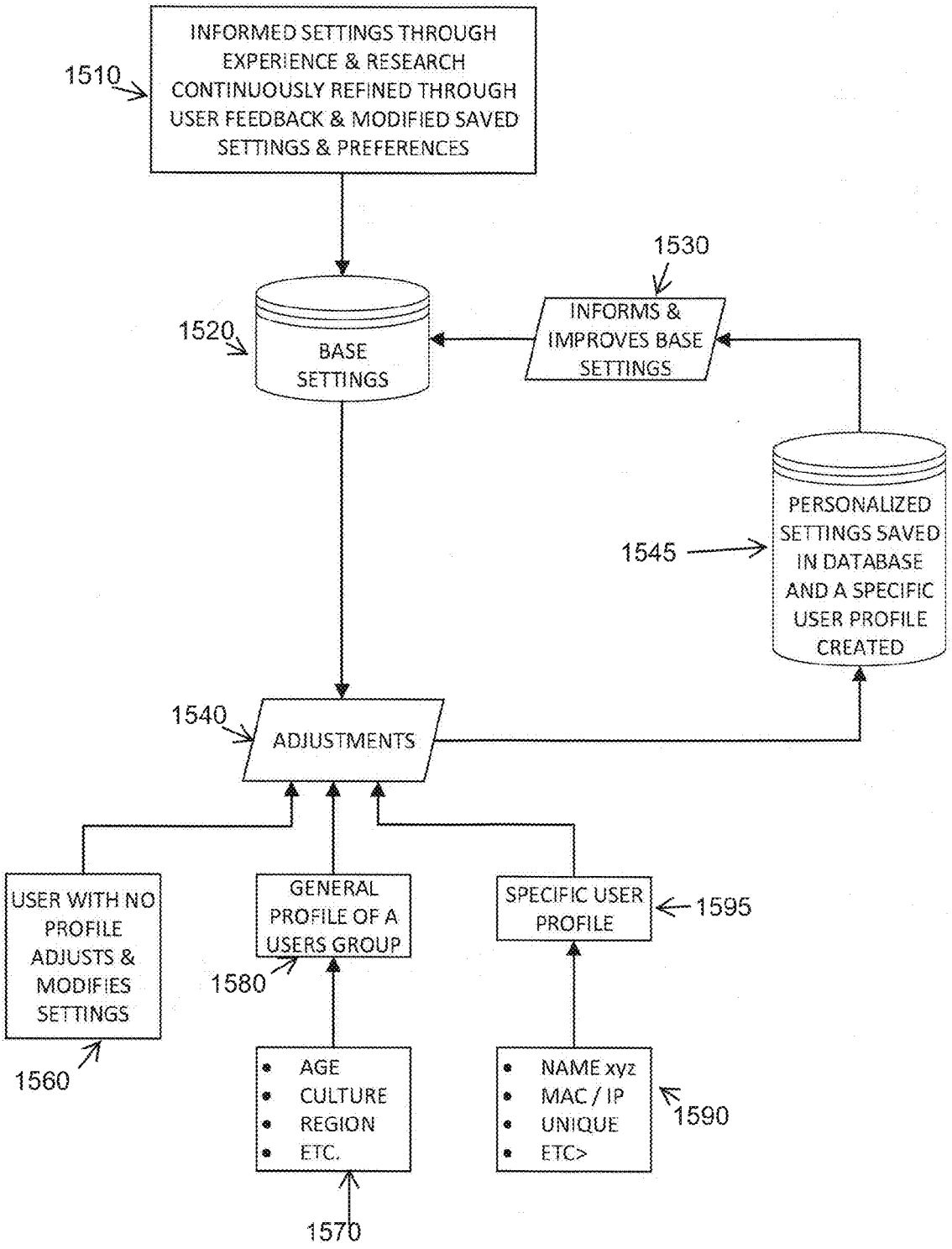
FIG. 15 is a representation of an example of a personalization and learning process of the present invention.

FIG. 15 is a representation of personalization and improvement of lighting scenes. Through experience and research that are continuously refined, including but not limited to by user feedback and modified saved settings and preferences 1510 there is a set of base settings 1520. The base settings are sent to an adjustments module 1540, which may consider the activity of a user who does not have a profile but who adjusts and modifies settings 1560, a general profile of a user's group 1580, e.g., age, culture, region in which she lives 1570, and/or a specific user profile 1595, which may for example, include a name and IP address 1590. With this information adjustments are made to implementation instructions for one more moods. The personalized settings are saved in a database and a specific user profile is created 1545. This specific user profile is used to inform and improve base settings 1530.

Example

Hotel Environment

A hotel provides a bedroom with a foyer and a bathroom to its client. It has a foyer down light, two floor lamps, a desk lamp, a right bedside lamp, a left bedside lamp, a miscellaneous backlit lamp, a bathroom down light and a bathroom mirror light. The system sets up the following mood lighting scenes as provided in table 5.

Table 5 for Dimmable Lights

| | LIGHT FIXTURES TYPE | ON | SCENE 1: GET-READY | SCENE 2: RELAX LOUNGE | SCENE 3: WORK | SCENE 4: NIGHT | OFF |
|---|---|---|---|---|---|---|---|
| 1 | LOBBY DOWN LIGHT | 100% | 100% | 20% | 30% | 0% | 0% |
| 2 | FLOOR LAMPS | 100% | 100% | 60% | 60% | 20% or 0% | 0% |
| 3 | DESKLAMP | 100% | 70% | 40% | 100% | 0% | 0% |
| 4 | BEDSIDE LAMPS 2 | 100% | 60% | 60% | 80% | 0% | 0% |
| 5 | BEDSIDE LAMPS 2 | 100% | 60% | 60% | 80% | 0% | 0% |
| 6 | MISC (e.g. backlit bedroom) | 100% | 90% | 50% | 40% | 20% | 0% |
| 7 | BATHROOM DOWN LIGHT | 100% | 80% | 40% | 10% | 0% | 0% |
| 8 | BATHROOM MIRROR | 100% | 100% | 80% | 60% | 30% | 0% |

In order to effectuate communication with the fixtures, unique identifiers may be used, e.g., SSID (network 802.11 environment), auto network configuration in an 802.11 environment, and Zigbee (ZLL (Zigbee Light Link) Zigbee Home Automation ZHA or JenNetIP specifications in a local 802.15.4 topology, Bluetooth or any other way these lighting and WiFi communication protocols may develop and be redefined.

Any of the features of the various embodiments described herein can be used in conjunction with features described in connection with any other embodiments disclosed unless otherwise specified. Thus, features described in connection with the various or specific embodiments are not to be construed as not suitable in connection with other embodiments disclosed herein unless such exclusivity is explicitly stated or implicit from context.

I claim:

1. A method for generating a mood lighting scene for an environment, said method comprising:

(a) receiving a profile for each of a plurality of lighting fixtures within a set of lighting fixtures for an environment, wherein the profile comprises a set of static properties and a set of variable properties, wherein the set of static properties comprises a fixture type and the set of variable properties comprises a controllable feature that when controlled corresponds to an illumination value;

(b) activating a computer protocol, wherein the computer protocol applies an algorithm to the profile of each of the lighting fixtures in the set of lighting fixtures, wherein the algorithm assigns an absolute or relative value for each of the variable properties to generate a set of illumination values that comprises an illumination value for each fixture for a mood lighting scene;

(c) generating a mood scene profile for the mood lighting scene, wherein the mood scene profile comprises a set of illumination instructions for the set of lighting fixtures for the mood lighting scene, wherein the set of illumination instructions corresponds to the set of illumination values;

(d) storing the mood scene profile;

(e) receiving a request to implement a selected mood lighting scene, wherein the selected mood lighting scene corresponds to the mood scene profile;

(f) retrieving the mood scene profile; and (g) transmitting a digital data message, wherein the digital data message comprises the illumination instructions for the selected mood lighting scene, wherein when implemented, the set of illumination instructions causes the set of lighting fixtures to generate the selected mood lighting scene, wherein the algorithm assigns the absolute or relative value for each of the variable properties by accessing a database that for each static property correlates each of a plurality of mood lighting scenes with an illumination value, the set of variable properties further comprises at least one property selected from an on/off capability, a dimmability capability, and a color changing capability, and the profile is defined as $(A,B_x)_n$ for each of 1 to n fixtures in the environment, wherein A is a static property that is a fixture type selected from the group consisting of down light, table light, wall sconce, floor lamp, pendant, up light, step light and strip light, $B_x$ is a variable property that corresponds to maximum illumination value, and n=1 to 100;

wherein for each scene within a set of m scenes, and the mood scene profile is defined as the set $(B_{x'})_{1\ to\ n}$.

2. The method of claim 1, wherein the profile comprises $(A, B_x,B_y,B_z)_n$, wherein $B_y$=maximum illumination in an up direction value, and $B_z$=maximum illumination in a directed light direction value, and the mood scene profile comprises $(B_{x'},B_{y'},B_{z'})_n$ wherein $B_{y'}$=implementation illumination in an up direction value, and $B_{z'}$=implementation illumination in a directed light direction value.

3. The method of claim 2, wherein the profile comprises $(A,B_x,B_y,B_z, B_a)_n$, wherein $B_a$=maximum illumination in a task oriented orientation, and the mood scene profile comprises $(B_{x'},B_{y'},B_{z'},B_{a'})_n$, wherein $B_{a'}$=implementation illumination in a task oriented orientation.

4. The method of claim 3, wherein said generating further comprises adjusting at least one of the stored set of scene implementation parameters to form adjusted scene implementation parameters, wherein said adjusting is a change of at least one of $B_x$, $B_y$, $B_z$, and $B_a$, for at least one A and the instruction that is transmitted comprises the adjusted scene implementation parameters.

5. The method according to claim 4, wherein the amount of change depends on the presence of at least two fixtures from the group consisting of down light, table light, wall sconce, floor lamp, pendant, up light, step light and strip light that are the same type.

6. The method according to claim 4, wherein the amount of change depends on the absence of at least one fixture from the group consisting of down light, table light, wall sconce, floor lamp, pendant, up light, step light and strip light that is the same type.

7. The method according to claim 4, wherein said adjusting is based on a user override.

8. The method according to claim 7, wherein the user override is the receipt of instructions from a user or sensors or prior stored preferences.

9. The method according to claim 4, wherein said adjusting is dependent on observed user behavior or environmental changes.

10. The method according to claim 4, wherein said adjusting in dependent on user demographic behavior.

11. A method for generating a mood lighting scene for an environment, said method comprising:

(a) receiving a profile for each of a plurality of lighting fixtures within a set of lighting fixtures for an environment, wherein the profile comprises a set of static properties and a set of variable properties, wherein the set of static properties comprises a fixture type and the set of variable properties comprises a controllable feature that when controlled corresponds to an illumination value;

(b) activating a computer protocol, wherein the computer protocol applies an algorithm to the profile of each of the lighting fixtures in the set of lighting fixtures, wherein the algorithm assigns an absolute or relative value for each of the variable properties to generate a set of illumination values that comprises an illumination value for each fixture for a mood lighting scene;

(c) generating a mood scene profile for the mood lighting scene, wherein the mood scene profile comprises a set of illumination instructions for the set of lighting fixtures for the mood lighting scene, wherein the set of illumination instructions corresponds to the set of illumination values;

(d) storing the mood scene profile;

(e) receiving a request to implement a selected mood lighting scene, wherein the selected mood lighting scene corresponds to the mood scene profile;

(f) retrieving the mood scene profile; and (g) transmitting a digital data message, wherein the digital data message comprises the illumination instructions for the selected mood lighting scene, wherein when implemented, the set of illumination instructions causes the set of lighting fixtures to generate the selected mood lighting scene, wherein the algorithm assigns the absolute or relative value for each of the variable properties by accessing a database that for each static property correlates each of a plurality of mood lighting scenes with an illumination value, and wherein the database comprises scene implementation parameters for at least 3 scenes $m_1$, $m_2$ and $m_3$, wherein for $m_1$ the scene implementation parameters when implemented combine to provide overall brightness of at least three times the overall brightness of $m_3$; and for $m_2$ the scene implementation parameters when implemented combine to provide overall brightness less than $m_1$ but at least two times the overall brightness of $m_3$.

12. A method for generating a mood lighting scene for an environment, said method comprising:

(a) receiving a profile for each of a plurality of lighting fixtures within a set of lighting fixtures for an environment, wherein the profile comprises a set of static properties and a set of variable properties, wherein the set of static properties comprises a fixture type and the set of variable properties comprises a controllable feature that when controlled corresponds to an illumination value;

(b) activating a computer protocol, wherein the computer protocol applies an algorithm to the profile of each of the lighting fixtures in the set of lighting fixtures, wherein the algorithm assigns an absolute or relative value for each of the variable properties to generate a set of illumination values that comprises an illumination value for each fixture for a mood lighting scene;

(c) generating a mood scene profile for the mood lighting scene, wherein the mood scene profile comprises a set of illumination instructions for the set of lighting fixtures for the mood lighting scene, wherein the set of illumination instructions corresponds to the set of illumination values;

(d) storing the mood scene profile;

(e) receiving a request to implement a selected mood lighting scene, wherein the selected mood lighting scene corresponds to the mood scene profile;

(f) retrieving the mood scene profile; and (g) transmitting a digital data message, wherein the digital data message comprises the illumination instructions for the selected mood lighting scene, wherein when implemented, the set of illumination instructions causes the set of lighting fixtures to generate the selected mood lighting scene; and (h) generating a mood lighting scene;

wherein the request is a first request and the mood lighting scene is a first mood lighting scene and the method further comprises (i) receiving a second request for the environment after receiving the first request;

(j) generating instructions for a second mood lighting scene; and (k) transmitting instructions for the second mood lighting scene to the fixtures thereby generating the second mood lighting.

13. A method for generating a mood lighting scene for an environment, said method comprising:

(a) receiving a profile for each of a plurality of lighting fixtures within a set of lighting fixtures for an environment, wherein the profile comprises a set of static properties and a set of variable properties, wherein the set of static properties comprises a fixture type and the set of variable properties comprises a controllable feature that when controlled corresponds to an illumination value;

(b) activating a computer protocol, wherein the computer protocol applies an algorithm to the profile of each of the lighting fixtures in the set of lighting fixtures, wherein the algorithm assigns an absolute or relative value for each of the variable properties to generate a set of illumination values that comprises an illumination value for each fixture for a mood lighting scene;

(c) generating a mood scene profile for the mood lighting scene, wherein the mood scene profile comprises a set of illumination instructions for the set of lighting fixtures for the mood lighting scene, wherein the set of illumination instructions corresponds to the set of illumination values;

(d) storing the mood scene profile;

(e) receiving a request to implement a selected mood lighting scene, wherein the selected mood lighting scene corresponds to the mood scene profile;

(f) retrieving the mood scene profile; and (g) transmitting a digital data message, wherein the digital data message comprises the illumination instructions for the selected mood lighting scene, wherein when implemented, the set of illumination instructions causes the set of lighting fixtures to generate the selected mood lighting scene, wherein steps (b) and (c) are repeated for a plurality of moods to generate a set of mood lighting scenes for the environment that comprises a plurality of mood lighting scenes.

14. The method according to claim 13, wherein a user selects a user selected mood lighting scene from set of mood lighting scenes for the environment and the method further comprises causing the fixtures to illuminate the environment to create the user selected mood lighting scene.

15. A method for generating a mood lighting scene for an environment, said method comprising:

(a) receiving a profile for each of a plurality of lighting fixtures within a set of lighting fixtures for an environment, wherein the profile comprises a set of static properties and a set of variable properties, wherein the set of static properties comprises a fixture type and the set of variable properties comprises a controllable feature that when controlled corresponds to an illumination value;

(b) activating a computer protocol, wherein the computer protocol applies an algorithm to the profile of each of the lighting fixtures in the set of lighting fixtures, wherein the algorithm assigns an absolute or relative value for each of the variable properties to generate a set of illumination values that comprises an illumination value for each fixture for a mood lighting scene;

(c) generating a mood scene profile for the mood lighting scene, wherein the mood scene profile comprises a set of illumination instructions for the set of lighting fixtures for the mood lighting scene, wherein the set of illumination instructions corresponds to the set of illumination values;

(d) storing the mood scene profile;

(e) receiving a request to implement a selected mood lighting scene, wherein the selected mood lighting scene corresponds to the mood scene profile;

(f) retrieving the mood scene profile; and (g) transmitting a digital data message, wherein the digital data message comprises the illumination instructions for the selected mood lighting scene, wherein when implemented, the set of illumination instructions causes the set of lighting fixtures to generate the selected mood lighting scene, wherein the algorithm assigns values for a mood lighting scene as follows:

(a) for a first fixture type, i. if the first fixture type is switchable then ON ii. if the first fixture type has dimmable capabilities then 80-100% of maximum brightness iii. if the first fixture type has color changing capabilities, then blueish white, and iv. if the first fixture type has dynamic white capabilities then assigning a value of 4000-5000K; and (b) for a second fixture type i. if the second fixture type is switchable then ON ii. if the second fixture type has dimmable capabilities then 50-90% of maximum brightness iii. if the second fixture type has color changing capabilities, then neutral to white, and iv. if the second fixture type has dynamic white capabilities then assigning a value of 3000-4000K.

16. The method according to claim 15, wherein the mood lighting scene is a first mood lighting scene, and for a second mood lighting scene, the algorithm assigns (a) for the first fixture type i. if the first fixture type is switchable then OFF ii. if the first fixture type has dimmable capabilities then 5-20% of maximum brightness iii. if the first fixture type has color changing capabilities, then amber color or deep bluish purple iv. if the first fixture type has dynamic white capabilities then assigning a value of 2000-2500K; and (b) for the second light type i. if the second fixture type is switchable then OFF; unless there is no other fixture in the space ii. if the second fixture type has dimmable capabilities then 10-30% of maximum brightness iii. if the second fixture type has color changing capabilities, then warm white, golden amber, and iv. if the second fixture type has dynamic white capabilities then assigning a value of 2300-2700K.

* * * * *